US007891330B2

(12) United States Patent
Kishibata et al.

(10) Patent No.: US 7,891,330 B2
(45) Date of Patent: Feb. 22, 2011

(54) ENGINE STARTING METHOD AND DEVICE

(75) Inventors: Kazuyoshi Kishibata, Numazu (JP); Tomohiro Kinoshita, Numazu (JP)

(73) Assignee: Kokusan Denki Co., Ltd., Numazu-shi (JP)

( * ) Notice: Subject to any disclaimer, the term of this patent is extended or adjusted under 35 U.S.C. 154(b) by 778 days.

(21) Appl. No.: 11/935,004

(22) Filed: Nov. 5, 2007

(65) Prior Publication Data

US 2008/0105230 A1 May 8, 2008

(30) Foreign Application Priority Data

Nov. 6, 2006 (JP) ..... 2006-300461

(51) Int. Cl.
*F02N 11/08* (2006.01)

(52) U.S. Cl. ..... 123/179.3; 123/179.14; 701/113

(58) Field of Classification Search ..... 123/179.1, 123/179.3, 179.4, 179.5, 179.7, 179.14, 179.15, 123/179.16, 179.17, 179.28; 701/112, 113
See application file for complete search history.

(56) References Cited

U.S. PATENT DOCUMENTS 6,799,547 B2 * 10/2004 Sieber ..... 123/179.5
6,877,470 B2 * 4/2005 Mitani et al. ..... 123/179.3

FOREIGN PATENT DOCUMENTS

JP 2002-332938 11/2002
JP 2007-132335 5/2007

* cited by examiner

*Primary Examiner*—Stephen K Cronin
*Assistant Examiner*—Raza Najmuddin
(74) *Attorney, Agent, or Firm*—Pearne & Gordon LLP

(57) ABSTRACT

An engine starting method for starting an engine by causing first fuel injection when a crankshaft is reversely rotated by a predetermined angle at the start, and then rotating the crankshaft forward to perform first ignition, the method comprising the steps of immediately stopping driving of a starter motor when a starter switch is turned off before the first fuel injection at the start; and continuously driving the starter motor forward until a cylinder into which an air/fuel mixture is supplied by the first fuel injection performs at least one exhaust stroke and then stopping the driving of the starter motor when the starter switch is turned off after the first fuel injection at the start.

20 Claims, 10 Drawing Sheets

Fig. 4A
Fig. 4B
Fig. 4C
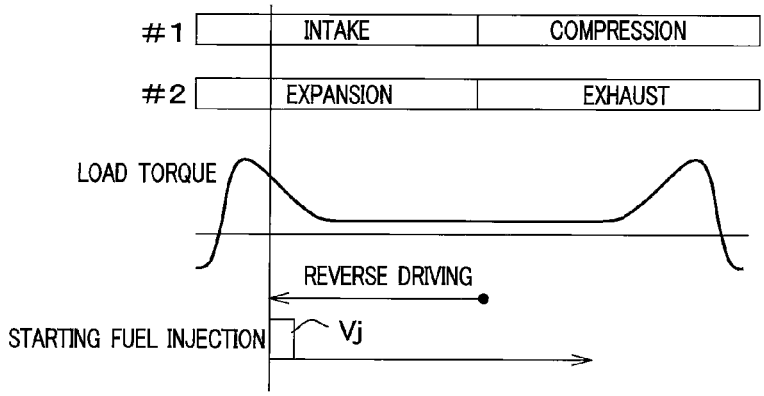
Fig. 5A
Fig. 5B
Fig. 5C
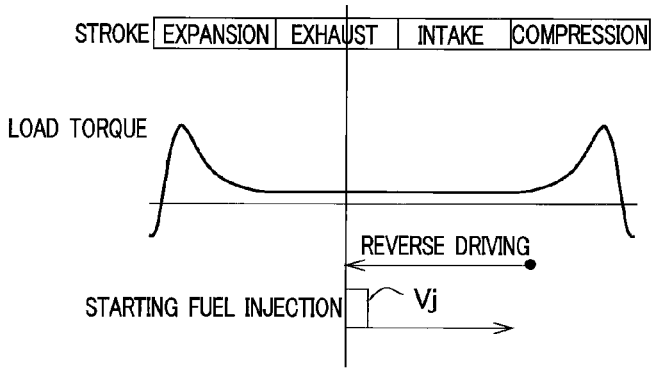

ENGINE STARTING METHOD AND DEVICE

TECHNICAL FIELD OF THE INVENTION

The present invention relates to an engine starting method for starting an engine comprising a starter motor, and an engine starting device used for implementing the method.

PRIOR ART OF THE INVENTION

Generally, when an engine is stopped, a compression load in a compression stroke of the engine acts as a brake in the process of inertial rotation of a crankshaft, the rotation once stops in the process of a piston in any of cylinders moving up toward a top dead center of the compression stroke, and then the piston is pushed back and stopped near a bottom dead center in many cases. Thus, in starting the engine, the crankshaft is rotated from the state where the piston in any of the cylinders is positioned near the bottom dead center of the compression stroke.

When the crankshaft is rotated forward for starting the engine in this position, the compression load of the compression stroke is applied to the crankshaft immediately after the start of the rotation, which prevents an increase in rotational speed and causes a maximum load to be applied to a starter motor at a crank angle position where the compression load is maximum. For a four cycle engine, a crank angle position where the compression load is maximum is around 30° before the top dead center of the compression stroke.

The starter motor needs to generate torque higher than maximum load torque applied to the crankshaft when the compression load becomes maximum. Particularly, when a rotor of the starter motor is directly connected to the crankshaft such as when a generator having a rotor directly connected to a crankshaft is used as a starter motor at the start of an engine, motor torque cannot be increased by a reduction mechanism, which requires use of a large expensive motor.

When the starter motor is used as the generator after the start of the engine, using a motor with high driving torque excessively increases inertia of the rotor because of a large mass thereof, thereby reducing response of the engine. Startability and the response of the engine are in a trade-off relationship, and improvement in both thereof is difficult.

In order to solve the problems, as disclosed in Japanese Patent Application Laid-Open Publication No. 2002-332938, an engine starting device is proposed that can overcome a compression stroke using a compact starter motor that outputs torque lower than maximum load torque applied to a crankshaft in the compression stroke of an engine by once rotating reversely and then rotating forward the starter motor before starting the engine.

In the starting device disclosed in Japanese Patent Application Laid-Open Publication No. 2002-332938, when a start command of the engine is given, the starter motor is once reversely rotated to increase a run-up distance of a piston at the start, then the starter motor is rotated forward to increase a rotational speed of the crankshaft in a run-up section with relatively low load other than the compression stroke, and the compression stroke is completed by the resultant force of inertial forces accumulated by rotation of the crankshaft and a rotation force of the motor.

Experiments by the present inventor have revealed that at a temperature of the engine at the start around −20° C. from room temperature, the engine can be started by the starting device disclosed in Japanese Patent Application Laid-Open Publication No. 2002-332938, while under extremely low temperature environments at the temperature of the engine below −20° C., the engine is difficult to start using the starter motor that outputs torque lower than the maximum load torque applied to the crankshaft in the compression stroke.

The engine is difficult to start under the extremely low temperature environments as described above because an increase in viscosity of engine oil or the like caused by a reduction in temperature suddenly increases torque (friction torque) applied to the crankshaft by sliding friction of a movable portion of the engine to excessively increase the maximum load torque (the sum of the compression torque and the friction torque) applied to the crankshaft in the compression stroke.

Specifically, under the extremely low temperature environments, the friction torque of the engine is considerable to extremely increase the maximum load torque applied to the starter motor in the compression stroke, and thus the engine cannot be started using the starter motor that outputs low torque.

Then, the present applicant has proposed an engine starting device that can start an engine even with high friction torque of the engine in Japanese Patent Application No. 2006-56344 (Laid-Open No. 2007-132335).

In the proposed engine starting device, a starter motor is driven in a direction reverse to a direction of starting the engine for once reversely rotating a crankshaft of the engine when a starter switch is turned on, and a fuel injection device performs first fuel injection at the start at a crank angle position within a crank angle range suitable for injecting fuel for generating an air/fuel mixture to be supplied into a cylinder of the engine in preparation for first ignition at the start performed by an ignition device. The starter motor is driven so as to rotate the crankshaft forward after the reverse driving of the starter motor is finished, and the ignition device performs the first ignition at the crank angle position suitable as an ignition position at the start of the engine in the process of forward rotation of the crankshaft. In the forward rotation of the crankshaft, the starter motor is continuously driven in the direction of starting the engine until the start of the engine is confirmed even when the crankshaft stops before a piston in the cylinder of the engine reaches a top dead center of a compression stroke.

It has been revealed that in the case where after the starter switch is turned on, the starter motor is reversely driven for once reversely rotating the crankshaft, the first fuel injection is performed when the crank angle position reaches a predetermined position, then the starter motor is driven forward, and the first ignition is performed when the crank angle position reaches the position suitable for performing the first ignition, the following problems occur when a driver once turns on the starter switch and then turns off the starter switch by misconstruing that the engine does not operate because of too quiet starting noise of the engine or the like.

Specifically, if the starter switch is turned off after the first fuel injection, fuel is accumulated in the cylinder with the starter motor being stopped, which generates too concentrated an air/fuel mixture when the starter switch is next turned on and reduces startability of the engine.

When an operation of turning on the starter switch and an operation of turning off the starter switch after the first fuel injection are repeated, the inside of the cylinder becomes excessively wet with fuel, which makes it difficult to start the engine.

SUMMARY OF THE INVENTION

The present invention has an object to provide an engine starting method and an engine starting device that can prevent a reduction in startability of an engine when a starter switch is turned on and then immediately turned off.

The present invention is applied to an engine starting method for starting an engine comprising at least one cylinder having a piston therein, a crankshaft connected to the piston in the cylinder, a fuel injection device that injects fuel for generating an air/fuel mixture to be supplied into the cylinder, an ignition device that ignites the air/fuel mixture compressed in the cylinder, and a starter motor that can rotationally drive the crankshaft forward and reversely.

In the present invention, the starter motor is reversely driven for once reversely rotating the crankshaft of the engine when the starter switch is turned on, and the starter motor is driven so as to rotate the crankshaft forward after the reverse driving of the starter motor is finished. Also, the fuel injection device performs first fuel injection at the start at a crank angle position within a crank angle range suitable for injecting fuel for generating the air/fuel mixture to be supplied into the cylinder of the engine in preparation for first ignition at the start of the engine performed by the ignition device, and the ignition device performs the first ignition at the crank angle position suitable as an ignition position at the start of the engine in the process of forward rotation of the crankshaft.

If the starter motor is reversely rotated when the starter switch is turned off, a piston in a particular cylinder that has stopped near a bottom dead center of a compression stroke is returned to any crank angle position at a midpoint in a section corresponding to an intake stroke during forward rotation or a crank angle position passing through the section corresponding to the intake stroke during forward rotation. When the starter motor is then rotated forward, the intake stroke is performed in the particular cylinder to supply the air/fuel mixture into the particular cylinder, and then the compression stroke is performed. In the ignition position of the engine, the air/fuel mixture containing the fuel supplied by the first fuel injection is compressed in the cylinder, and thus the ignition device performs an ignition operation to perform an expansion stroke and start the engine.

If the starter switch is turned off after the first fuel injection as described above, the fuel is accumulated in the cylinder, which generates too concentrated an air/fuel mixture when the starter switch is next turned on and reduces startability of the engine.

Thus, in the present invention, the driving of the starter motor is immediately stopped when the starter switch is turned off before the first fuel injection at the start, and the starter motor is continuously driven forward until the cylinder into which the air/fuel mixture is supplied by the first fuel injection performs at least one exhaust stroke and then stopped when the starter switch is turned off after the first fuel injection at the start.

As described above, when the starter switch is turned off after the first fuel injection, the driving of the starter motor is not immediately stopped but the starter motor is continuously driven until the cylinder into which the air/fuel mixture is supplied by the first fuel injection performs at least one exhaust stroke and then stopped. This prevents fuel from being accumulated in the cylinder, and thus prevents the inside of the cylinder from becoming wet with the fuel to make the next start of the engine difficult.

The crank angle position where the first fuel injection is performed may be a predetermined position or a crank angle position when a reverse driving time of the starter motor reaches a set time.

It is preferable that in forward rotation of the crankshaft, the starter motor is continuously driven in the direction of starting the engine until the start of the engine is confirmed even when the crankshaft stops before the piston in the cylinder of the engine reaches the top dead center of the compression stroke.

When the engine is started at extremely low temperature, the sum of compression torque and friction torque exceeds output torque of the starter motor in the compression stroke and the crankshaft stops in some cases. At this time, if the starter motor is continuously driven forward, the piston of the engine can be slowly displaced toward the top dead center of the compression stroke with gradual reduction in the compression torque by a compression leak in the cylinder of the engine, and the starter motor can accelerate the crankshaft after the compression torque exceeds a maximum value to complete the compression stroke. At this time, the air/fuel mixture is compressed in the cylinder, and thus the ignition operation is successively performed to perform an expansion stroke, and the crankshaft can be sharply accelerated to start the engine.

The present invention is also applied to an engine starting device for starting an engine comprising: at least one cylinder having a piston therein; a crankshaft connected to the piston in the cylinder; a fuel injection device that injects fuel for generating an air/fuel mixture to be supplied into the cylinder; an ignition device that ignites the air/fuel mixture compressed in the cylinder; and a starter motor that can rotationally drive the crankshaft forward and reversely.

The engine starting device according to the present invention comprises: starter reverse rotation drive means for reversely driving the starter motor for once reversely rotating the crankshaft of the engine when a command signal for commanding to start the engine is issued; starter forward rotation drive means for driving the starter motor so as to rotate the crankshaft forward after the reverse driving of the starter motor is finished; fuel injection control means for causing the fuel injection device to perform first fuel injection at the start at a crank angle position within a crank angle range suitable for injecting fuel for generating the air/fuel mixture to be supplied into the cylinder of the engine in preparation for first ignition at the start performed by the ignition device; start time ignition control means for causing the ignition device to perform the first ignition at the crank angle position suitable as an ignition position at the start of the engine in the process of forward rotation of the crankshaft; and start command issuing, and canceling control means for issuing the start command when a starter switch, which is turned on at the start of the engine, is turned on, immediately canceling the start command when the starter switch is turned off before the first fuel injection at the start, and continuously issuing the start command until the cylinder into which the air/fuel mixture is supplied by the first fuel injection performs at least one exhaust stroke and then canceling the start command when the starter switch is turned off after the first fuel injection at the start.

According to the present invention, when the starter motor is reversely driven and the starter switch is turned off after the first fuel injection, the driving of the starter motor is not immediately stopped but the starter motor is continuously driven during a set delay time and then stopped. This prevents fuel from being accumulated in the cylinder, and thus prevents the inside of the cylinder from becoming wet with the fuel to make the next start of the engine difficult.

BRIEF DESCRIPTION OF THE DRAWINGS

The above and other objects and features of the invention will be apparent from the detailed description of the preferred embodiment of the invention, which is described and illustrated with reference to the accompanying drawings, in which;

FIGS. 4A to 4C illustrate a relationship between strokes of two cylinders of a parallel two cylinder four cycle engine, changes in load torque with changes in crank angle, and first fuel injection performed when reverse driving is finished in the starting device according to the present invention;

FIGS. 5A to 5C illustrate stroke changes of a single cylinder four cycle engine, changes in load torque with changes in crank angle, and first fuel injection performed when reverse driving is finished in the starting device according to the present invention;

DETAILED DESCRIPTION OF THE PREFERRED EMBODIMENTS

Figure 1:
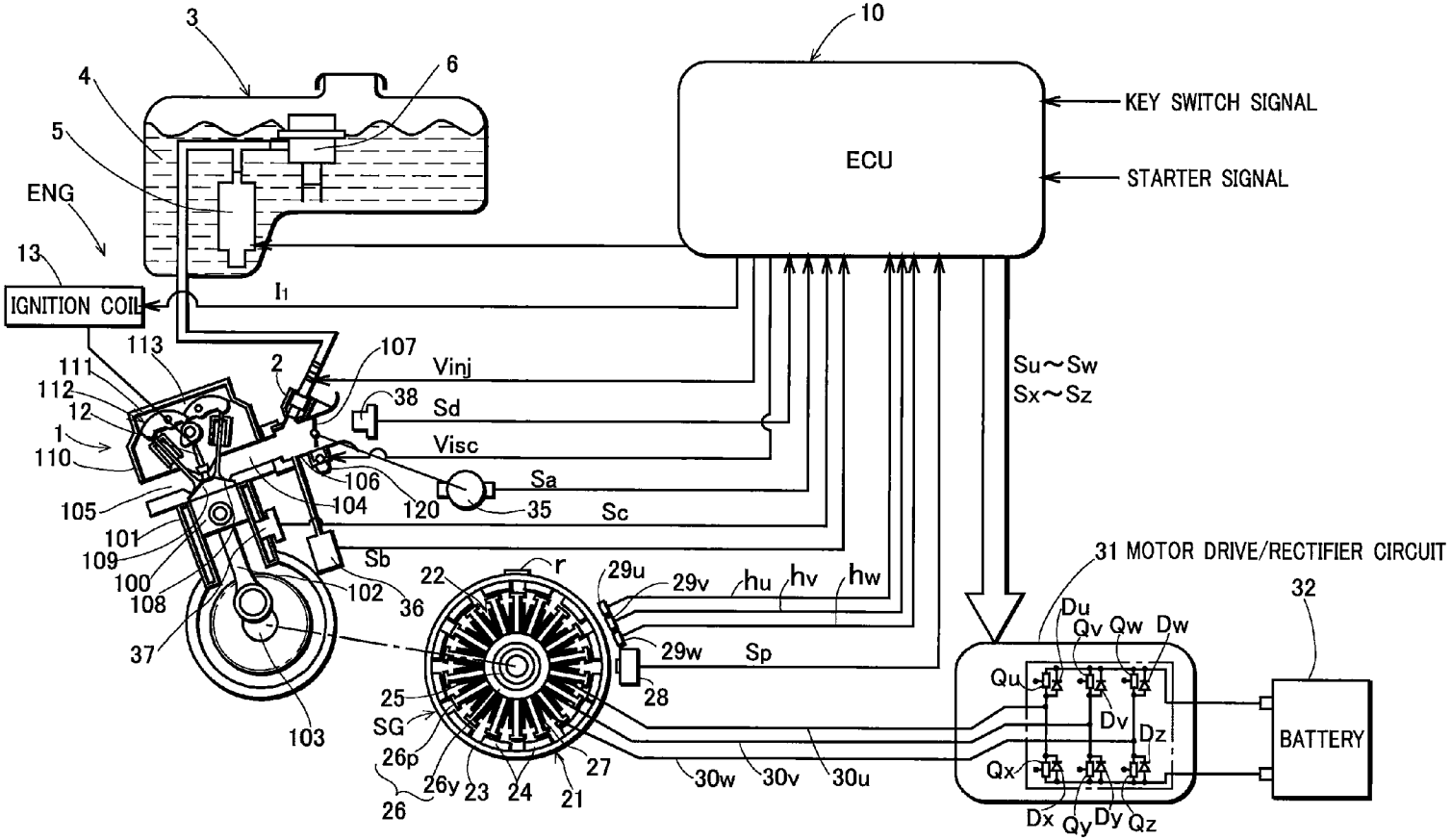
FIG. 1 shows a construction of hardware of an engine system to which a starting device according to the present invention is applied.

FIG. 1 shows a construction of an engine system comprising an engine starting device according to the present invention. In FIG. 1, ENG denotes a parallel two cylinder four cycle engine, and combustion cycles of a first cylinder and a second cylinder of the engine have a phase difference of 360°. A reference numeral 1 denotes an engine body, which comprises two cylinders 101 (the first cylinder only is shown) having a piston 100 therein, and a crankshaft 103 connected to the piston 100 in the cylinder via a connecting rod 102.

The starting device according to the present invention may be applied to the case where one common intake pipe is provided for a plurality of cylinders, but in the embodiment, an intake pipe 104 is provided for each cylinder of the engine. The engine ENG also comprises a fuel injection device that injects fuel for generating an air/fuel mixture to be supplied into the cylinder 101 through an intake pipe 106, an ignition device that ignites the air/fuel mixture compressed in the cylinder 101, and a starter motor that can rotationally drive the crankshaft 103 forward and reversely.

In the shown example, an injector (electromagnetic fuel injection valve) 2 is mounted so as to inject fuel into an intake pipe or an intake port downstream of a throttle valve 107. The injector 2 is a known one having an injector body with an injection hole at a tip thereof, a needle valve that opens and closes the injection hole, and a solenoid that drives the needle valve, and fuel is supplied into the injector body from a fuel pump 5 that pumps fuel 4 in a fuel tank 3. A pressure of the fuel supplied from the fuel pump 5 to the injector 2 is maintained constant by a pressure regulator 6. The solenoid of the injector 2 is connected to an injector drive circuit provided in an electronic control unit (ECU) 10. The injector drive circuit supplies a driving voltage to the solenoid of the injector 2 when an injection command signal is generated in the ECU. The injector 2 opens the valve while the driving voltage Vinj is supplied from the injector drive circuit to the solenoid and injects fuel into the intake pipe. When the pressure of the fuel supplied to the injector is maintained constant, an injection amount of the fuel is controlled by an injection time (a time during which the valve of the injector is opened).

In this example, the fuel injection device is comprised of the injector 2, the unshown injector drive circuit, and fuel injection control means for giving an injection command to the injector drive circuit To a cylinder head of the engine body, an ignition plug 12 for each cylinder is mounted with a discharge gap at a tip thereof facing a combustion chamber in each cylinder 101, and the ignition plug for each cylinder is connected to secondary side of an ignition coil 13 for each cylinder. A primary side of the ignition coil 13 for each cylinder is connected to an unshown ignition circuit provided in the ECU 10. The ignition circuit is a circuit that suddenly changes a primary current I1 of the ignition coil 13 to induce high voltage for ignition on the secondary side of the ignition coil 13 when receiving an ignition command from an ignition command issuing portion. An ignition device that ignites the engine is comprised of the unshown ignition circuit, the ignition plug 12, the ignition coil 13, and the ignition command issuing portion that provides the ignition command signal to the ignition circuit. The ignition command issuing portion is comprised of normal time ignition control means for arithmetically operating an ignition position during normal operation of the engine and issuing an ignition command when the arithmetically operated ignition position is detected, and start time ignition control means for issuing an ignition command at an ignition position suitable for starting the engine at the start of the engine.

In the engine in FIG. 1, an ISC (Idle Speed Control) valve 120 is provided that is operated by the solenoid so as to bypass a throttle valve. An ISC valve drive circuit that provides a drive signal Visc to the ISC valve 120 is provided in the ECU 10, and the drive signal Visc is provided to the ISC valve 120 so as to maintain a constant idling speed of the engine.

In the embodiment, a rotating electric machine (referred to as a starter generator) SG, which is driven as a brushless motor at the start of the engine and operated as a generator after the start of the engine, is mounted to the engine, and the rotating electric machine SG is used as a starter motor. The rotating electric machine SG is comprised of a rotor 21 mounted to the crankshaft 103 of the engine, and a stator 22 secured to a case or the like of the engine body.

The rotor 21 is comprised of a cup-like ferrous rotor yoke 23, and permanent magnets 24 mounted to an inner periphery thereof, and in this example, the permanent magnets 24 mounted to the inner periphery of the rotor yoke 23 produce 12-pole magnetic fields. The rotor 21 is mounted to the crankshaft 103 by fitting a tapered portion at a tip of the crankshaft 103 of the engine in a tapered hole formed in a boss 25 provided at the center of a bottom wall portion of the rotor yoke 23, and fastening the boss 25 to the crankshaft 103 by a screw member.

The stator 22 is comprised of a stator iron core 26 having a structure with 18 salient pole portions 26*p* radially protruding from an outer periphery of an annular yoke 26*y*, and an armature coil 27 wound around the series of salient pole portions 26*p* of the stator iron core and three-phase connected, and a magnetic pole portion at a tip of each salient pole portion 26*p* of the stator iron core 26 faces a magnetic pole portion of the rotor with a predetermined gap therebetween.

A reluctor r constituted by an arcuate protrusion is formed on an outer periphery of the rotor yoke 23, and a signal generator 28 that detects a leading edge and a trailing edge in a rotational direction of the reluctor r to generate pulses having different polarities is mounted to a case side of the engine. Hall sensors 29*u* to 29*w* such as Hall ICs, which are placed in detection positions set for the three-phase armature coils and detect polarities of the magnetic poles of the magnetic fields of the rotor 21, are provided on a stator side of the rotating electric machine SG. In FIG. 1, the three-phase Hall sensors 29*u* to 29*w* are shown placed outside the rotor yoke 23, but actually, the three-phase Hall sensors 29*u* to 29*w* are placed inside the rotor 21 and mounted to a printed circuit board secured to the stator 22. The Hall sensors are provided in the same manner as in a general three-phase brushless motor. The Hall sensors 29*u* to 29*w* output position detection signals hu to hw that are voltage signals having different levels between when the detected magnetic pole is a north pole and when the detected magnetic pole is a south pole.

The three-phase armature coils of the rotating electric machine SG are connected to AC terminals of a motor drive and rectifier circuit 31 through wires 30*u* to 30*w*, and a battery 32 is connected across DC terminals of the motor drive and rectifier circuit 31. The motor drive and rectifier circuit 31 is a known circuit comprising a bridge type three-phase inverter circuit (motor drive circuit) in which switch elements Qu to Qw and Qx to Qz that can be controlled on/off such as MOSFETs or power transistors form sides of a three-phase H bridge, and a diode bridge three-phase full-wave rectifier circuit comprised of diodes Du to Dw and Dx to Dz connected in anti-parallel with the switch elements Qu to Qw and Qx to Qz of the inverter circuit.

When the rotating electric machine SG is operated as the brushless motor (starter motor), the switch elements of the inverter circuit are controlled on/off according to a rotational angle position of the rotor 21 detected from outputs of the Hall sensors 29*u* to 29*w*, and thus a driving current that is commutated in a predetermined phase order is supplied from the battery 32 through the inverter circuit to the three-phase armature coil 27.

When the rotating electric machine SG is operated as the generator after the start of the engine, a three-phase AC output obtained from the armature coil 27 is supplied through the full-wave rectifier circuit in the motor drive and rectifier circuit 31 to the battery 32 and various loads (not shown) connected across the battery 32. At this time, the switch elements that form an upper side or a lower side of the bridge of the inverter circuit are simultaneously controlled on/off according to the voltage across the battery 32, and thus the voltage across the battery 32 is controlled so as not to exceed a set value.

For example, when the voltage across the battery 32 is the set value or less, the switch elements Qu to Qw and Qx to Qz that form the H bridge of the inverter circuit are maintained in an off state, and the output of the rectifier circuit in the motor drive and rectifier circuit 31 is applied as it is to the battery 32. When the voltage across the battery 32 exceeds the set value, the three switch elements Qx to Qz that form three lower sides (or upper sides) of the bridge of the inverter circuit are simultaneously turned on, and thus the three-phase AC output of the generator is short-circuited to reduce the voltage across the battery 32 to the set value or less. Repeating these operations allows the voltage across the battery 32 to be maintained at around the set value.

Instead of the above described control, it may be allowed that means for controlling the inverter circuit is provided so as to apply an AC control voltage having the same frequency as an induced voltage of the armature coil and having a predetermined phase angle relative to an induced voltage at the time of no-load of the armature coil, from the battery 32 to the armature coil of the rotating electric machine SG, and the phase of the AC control voltage supplied from the battery to the armature coil according to changes in the voltage across the battery is changed relative to the no-load induced voltage of the armature coil, thereby increasing or reducing generation outputs of the rotating electric machine to maintain the voltage across the battery 32 within a set range.

When MOSFETs are used as the switch elements that form the sides of the bridge of the inverter circuit, parasitic diodes formed between drains and sources of the MOSFETs can be used as the diodes Du to Dw and Dx to Dz.

In the shown example, in order to provide information on the engine to a microprocessor of the ECU 10, there are provided a throttle position sensor 35 that detects a position (an opening degree) of the throttle valve 107, a pressure sensor 36 that detects an internal pressure of an intake pipe downstream of the throttle valve 107, a cooling water temperature sensor 37 that detects a cooling water temperature of the engine, and an intake air temperature sensor 38 that detects a temperature of air taken in by the engine.

As described above, in the embodiment, the rotor of the rotating electric machine (starter generator) SG is directly connected to the crankshaft of the engine, the rotating electric machine is used as the starter motor at the start of the engine, and the rotating electric machine is used as the generator after the start of the engine. However, in the following description on the engine starting device, the rotating electric machine SG is referred to as the starter motor for convenience because the description is directed to control when the rotating electric machine SG is operated as the starter motor.

Figure 2:
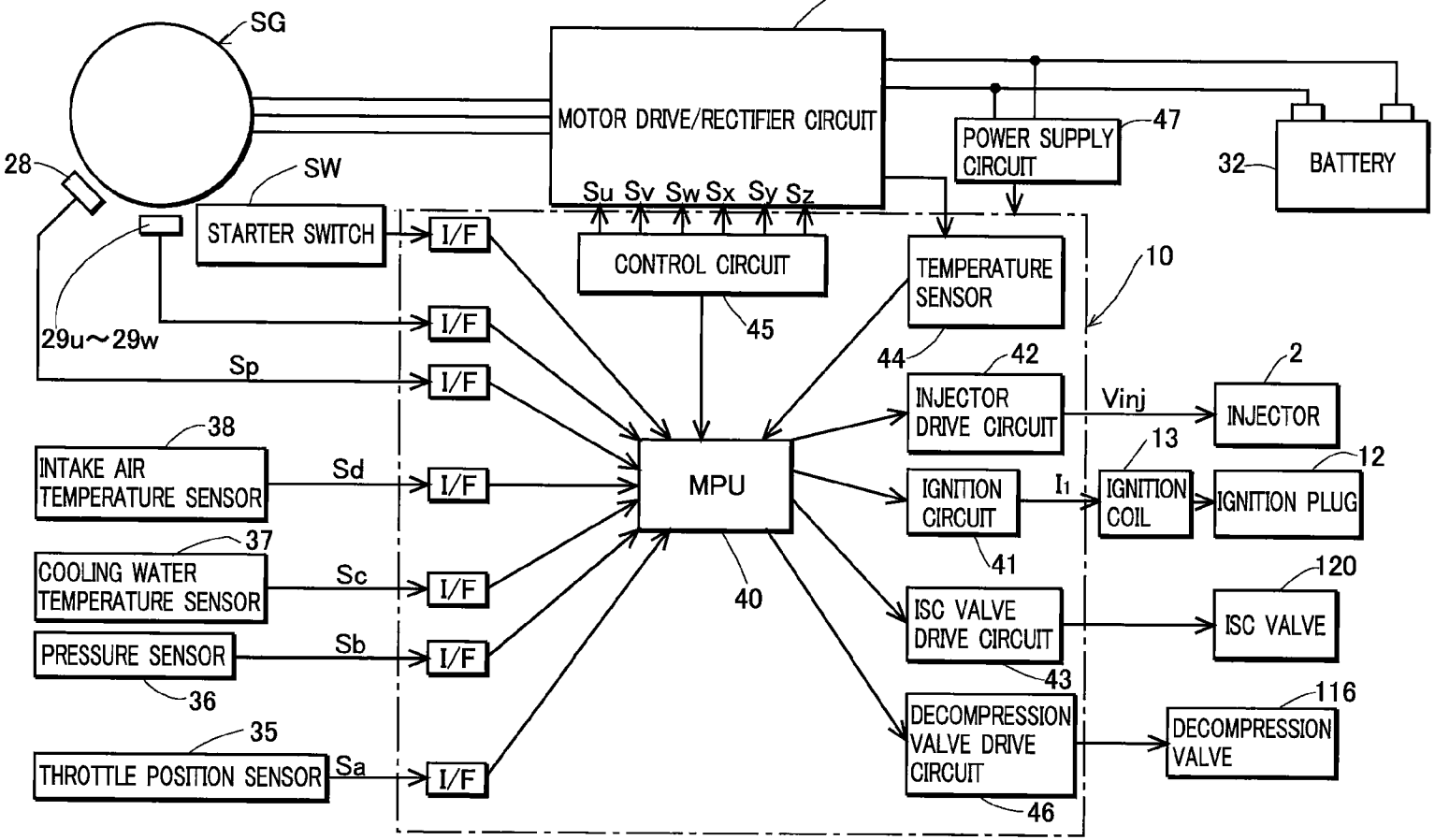
FIG. 2 is a block diagram of an electrical construction of the system in FIG. 1.

FIG. 2 is a block diagram of an electrical construction of the system in FIG. 1. The ECU 10 comprises a microprocessor (MPU) 40, an ignition circuit 41, an injector drive circuit 42, an ISC valve drive circuit 43, a temperature sensor 44 that detects a temperature of the motor drive and rectifier circuit 31, a control circuit 45 that provides drive signals to the switch elements of the inverter circuit of the motor drive and rectifier circuit 31 according to commands given from the microprocessor 40, a decompression valve drive circuit 46 that supplies a driving current to a decompression valve 116, and a predetermined number of interface circuits I/F.

The microprocessor 40 performs predetermined programs stored in a ROM to construct various control means required for controlling the engine. In the shown example, in order to provide information on the engine to the microprocessor, a throttle position signal Sa obtained from the throttle position sensor 35, an intake pipe internal pressure detection signal Sb obtained from the pressure sensor 36, a cooling water temperature detection signal Sc obtained from the cooling water temperature sensor 37, and an intake air temperature detection signal Sd obtained from the intake air temperature sensor 38 are input to the microprocessor in the ECU 10 through the interface circuits I/F. The output signals hu to hw of the Hall sensors 29*u* to 29*w* and an output Sp of the signal generator 28 are input to the microprocessor 40 through predetermined interface circuits I/F.

Then, the primary current I1 is supplied from the ignition circuit 41 in the ECU 10 to the ignition coil 13, and a driving voltage Vinj is supplied from the injector drive circuit 42 in the ECU 10 to the injector 2. Drive signals (signals for turning on the switch elements) Su to Sw and Sx to Sz are provided from the control circuit 45 to the six switch elements Qu to Qw and Qx to Qz, respectively, of the inverter circuit of the motor drive and rectifier circuit 31.

In FIG. 2, a reference numeral 47 denotes a power supply circuit to which an output voltage of the battery 32 is input, and the power supply circuit 47 reduces and stabilizes the output voltage of the battery 32 to output, a power supply voltage to be supplied to each component of the ECU 10.

Figure 3:
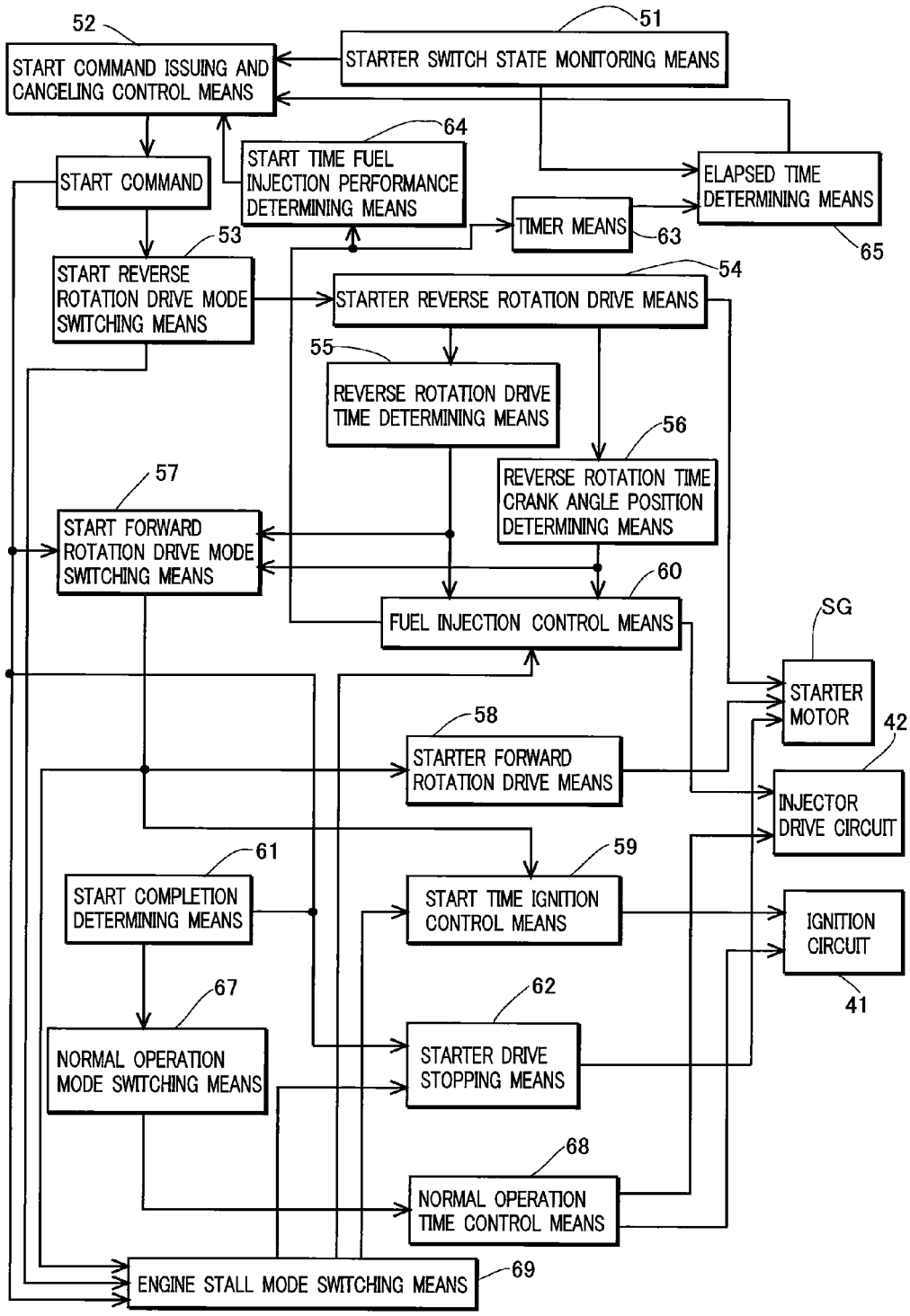
FIG. 3 is a block diagram of a construction of an engine starting device according to the present invention.

FIG. 3 shows a construction of essential portions of a control device including various control means constructed by the microprocessor 40 in the embodiment. In FIG. 3, a reference numeral 51 denotes starter switch state monitoring means for monitoring a state of a starter switch SW that is turned on at the start of the engine, 52 denotes start command issuing and canceling control means for issuing and canceling a start command, 53 denotes start reverse rotation drive mode switching means for switching a control mode to a start reverse rotation drive mode when the start command is issued, and 54 denotes starter reverse rotation drive means for reversely driving the starter motor SG for reversely rotating the crankshaft of the engine when the start reverse rotation drive mode switching means 52 switches the control mode to the start reverse rotation drive mode. A reference numeral 55 denotes reverse rotation drive time determining means for determining whether an elapsed time from the start of the reverse driving of the starter motor reaches a delay time set to a sufficient length of time for a piston in a particular cylinder, which has stopped near the bottom dead center of the compression stroke during forward rotation at the stop of the engine, to reach a set position, 56 denotes reverse rotation time crank angle position determining means for determining whether the piston in the particular cylinder reaches the set position in the process of reverse driving of the starter motor SG. The set position of the piston is set to any position in a section corresponding to an intake stroke during forward rotation of the engine (preferably, a position near the top dead center of the intake stroke during forward rotation) or a position passing through the section corresponding to the intake stroke during forward rotation of the engine. The "position passing through the section corresponding to the intake stroke during forward rotation of the engine" may be a position in a section corresponding to an exhaust stroke during forward rotation or a position passing through the section corresponding to the exhaust stroke during forward rotation (for example, any position in a section corresponding to an expansion stroke during forward rotation).

Further, a reference numeral 57 denotes start forward rotation drive mode switching means for switching the control mode to a start forward rotation drive mode when the reverse rotation drive time determining means 55 determines that the elapsed time reaches the set delay time or the reverse time crank angle position determining means 56 determines that the crank angle position reaches the set position, and 58 denotes starter forward rotation drive means for starting forward driving of the starter motor SG when the control mode is switched to the start forward rotation drive mode.

A reference numeral 59 denotes start time ignition control means for causing ignition at the start in a cylinder that has reaches an ignition position, which is a crank angle position after the top dead center position of the compression stroke in the process of forward rotation of the crankshaft, and 60 denotes fuel injection control means for causing first fuel injection for a particular cylinder of the engine when the reverse rotation drive time determining means 55 determines that the elapsed time has reached the set time or when the reverse time crank angle position determining means 56 determines that the crank angle position reaches the set position, and thereafter causing a fuel injection device to perform fuel injection at a crank angle position suitable as a position for injecting fuel for generating the air/fuel mixture to be supplied into the cylinder where the ignition is performed.

Further, a reference numeral 61 denotes start completion determining means for determining whether the start of the engine has completed, and 62 denotes starter drive stopping means for stopping the driving of the starter motor when the start completion determining means 61 determines that the start of the engine has completed and when the start command is cancelled.

A reference numeral 63 denotes timer means for measuring an elapsed time from the time when the fuel injection control means 60 causes the first fuel injection (an elapsed time after the first fuel injection), 64 denotes start time fuel injection performance determining means for determining whether the first fuel injection is performed when the starter switch state monitoring means 51 determines that the starter switch SW is off, and 65 denotes elapsed time determining means for determining whether the elapsed time measured by the timer means 63 reaches a set delay time Td when the start time fuel injection performance determining means 64 determines that the first fuel injection is performed. The delay time Td is set to time equal to or longer than time required for a cylinder into which the air/fuel mixture is taken by the first fuel injection to perform at least one exhaust stroke when the starter motor is continuously driven forward.

The start command issuing and canceling control means 52 used in the embodiment issues a start command when the starter switch state monitoring means 51 determines that the starter switch SW is on, continuously issues the start command when the starter switch state monitoring means 51 determines that the starter switch is off, the start time fuel injection performance determining means determines that the first fuel injection is performed, and the elapsed time determining means determines that the elapsed time has not yet reached the set delay time, and cancels the start command when the starter switch state monitoring means determines that the starter switch is off, and the start time fuel injection performance determining means determines that the first fuel injection is not performed, and when the starter switch state monitoring means 51 determines that the starter switch is off, the start time fuel injection performance determining means determines that the first fuel injection is performed, and the elapsed time determining means determines that the elapsed time has reached the set delay time.

A reference numeral 67 denotes normal operation mode switching means for switching the control mode to a normal operation mode when the start completion determining means 60 determines that the start of the engine has completed, and 68 denotes normal operation time control means for controlling a fuel injection amount and an ignition position during normal operation of the engine. The normal operation control means 68 comprises normal time fuel injection control means for arithmetically operating a fuel injection time relative to various control conditions during normal operation (after the start) of the engine and providing an injection command signal to the injector drive circuit 42 so as to inject fuel from the injector during the arithmetically operated injection time, and normal time ignition control means for arithmetically operating an ignition position during normal operation of the engine and giving an ignition command to an ignition circuit when the arithmetically operated ignition position is detected.

A reference numeral 69 denotes engine stall mode switching means for switching the control mode to an engine stall mode when it is detected that the start command of the engine is not given, that the start command is given but the starter switch is off, and that the start command is given but a control system has any error, in a state where the control mode is switched to the start reverse rotation drive mode or the start forward rotation drive mode. In the engine stall mode, a series of processings are performed required for maintaining the engine in a stop state such as prohibition of issuing the ignition command and the injection command. Specifically, in the embodiment, when the starter switch state monitoring means detects that the starter switch is turned off, the control mode is switched to the engine stall mode to prevent ignition of the engine and injection of fuel.

The starter forward rotation drive means 58 is comprised so as to continuously drive the starter motor SG forward while controlling the driving current of the starter motor SG at an upper limit value or less even when the crankshaft stops before the piston in the particular cylinder reaches the top dead center of the compression stroke at the start.

As described above, in a preferred aspect of the present invention, the engine starting device comprises: the starter reverse rotation drive means 54 for reversely driving the starter motor for once reversely rotating the crankshaft when the start command for commanding to start the engine is issued; the starter forward rotation drive means 58 for driving the starter motor forward so as to rotate the crankshaft forward after the driving of the starter motor by the starter reverse rotation drive means is finished; the fuel injection control means 60 for causing the fuel injection device to perform the first fuel injection at the start at the crank angle position within the crank angle range suitable for injecting fuel for generating the air/fuel mixture to be supplied into the cylinder of the engine in preparation for the first ignition at the start performed by the ignition device; the start time ignition control means 59 for causing the ignition device to perform the ignition at the crank angle position suitable as the ignition position at the start of the engine; the timer means 63 for measuring the elapsed time from the time when the fuel injection control means causes the first fuel injection (the elapsed time after the first fuel injection); the starter switch state monitoring means 51 for monitoring the state of the starter switch that is turned on at the start of the engine; the start time fuel injection performance determining means 64 for determining whether the first fuel injection is performed when the starter switch state monitoring means determines that the starter switch is off, the elapsed time determining means 65 for determining whether the elapsed time measured by the timer means reaches the set delay time when the start time fuel injection performance determining means determines that the first fuel injection is performed; the start command issuing and canceling control means 52 for issuing the start command when the starter switch state monitoring means 51 determines that the starter switch is on, continuously issuing the start command when the starter switch state monitoring means 51 determines that the starter switch is off, the start time fuel injection performance determining means 64 determines that the first fuel injection is performed, and the elapsed time determining means determines that the elapsed time has not yet reached the set delay time, and canceling the start command when the starter switch state monitoring means 51 determines that the starter switch is off, and the start time fuel injection performance determining means 64 determines that the first fuel injection is not performed, and when the starter switch state monitoring means 51 determines that the starter switch is off, the start time fuel injection performance determining means 64 determines that the first fuel injection is performed, and the elapsed time determining means 65 determines that the elapsed time has reached the set delay time; and the starter drive stopping means 62 for stopping the driving of the starter motor when the start of the engine is completed and the start command is canceled.

The delay time is set to time equal to or longer than the time required for the cylinder into which the air/fuel mixture is taken by the first fuel injection to perform at least one exhaust stroke when the starter motor is continuously driven forward.

Now, the control performed in the engine starting device according to the present invention will be described.

When the starter switch SW is turned on in the engine starting device according to the present invention, the starter switch state monitoring means 51 issues a start command. When the start command is issued, in order for the air/fuel mixture to be taken into the cylinder that is first ignited at the start, the starter motor SG is reversely driven to reversely rotate the crankshaft of the engine until the piston in the particular cylinder, which has stopped near the bottom dead center of the compression stroke during forward rotation of the engine at the stop of the engine, reaches any position in a section corresponding to the intake stroke during forward rotation of the engine (a position as near the top dead center of the intake stroke as possible) or a position passing through the section corresponding to the intake stroke during forward rotation of the engine.

FIG. 4A shows a relationship of strokes of two cylinders of the parallel two cylinder four cycle engine, and FIG. 4B shows load torque applied to the crankshaft when the crankshaft is externally rotated. In FIG. 4A, #1 and #2 denote a first cylinder and a second cylinder, respectively, of the engine. When the crankshaft of the engine is reversely rotated, compression torque of air in the cylinder is applied to the crankshaft as the load torque in a section corresponding to the expansion stroke during forward rotation. In the parallel two cylinder four cycle engine, as shown in FIG. 4A, when one cylinder is in the intake stroke, the other cylinder is in the expansion stroke. Thus, when the starter motor is reversely driven at the start to move up the piston in one cylinder (the first cylinder in the example in FIG. 4) that has stopped near the bottom dead center of the compression stroke toward the top dead center of the intake stroke during forward rotation, the compression torque does not act in one cylinder, while the compression torque acts in the other cylinder (the second cylinder in the example in FIG. 4). Thus, when a starter motor that outputs low torque is used, the piston in one cylinder that, has stopped near the bottom dead center of the compression stroke cannot reach the position corresponding to the top dead center of the intake stroke during forward rotation. Thus, in the case of the parallel two cylinder four cycle engine, the crankshaft stops when the piston in one cylinder (the first cylinder in the shown example) reaches a midpoint in the section corresponding to the intake stroke during forward rotation in reverse rotation of the crankshaft as shown in FIG. 4B.

When the crankshaft stops (before forward rotation of the crankshaft), as shown in FIG. 4C, the injection command signal Vj is provided to the injector drive circuit to cause the first fuel injection in preparation for the first ignition at the start.

In the case of a single cylinder four cycle engine, as shown in FIGS. 5A and 5B, when the starter motor is reversely driven, the compression torque is not applied to the crankshaft, and thus the crankshaft can be easily reversely rotated to near the crank angle position corresponding to the top dead center of the intake stroke during forward rotation. Also in this case, when the crankshaft is stopped (before forward rotation of the crankshaft), as shown in FIG. 5C, the injection command signal Vj is provided to the injector drive circuit to cause the fuel injection device to perform the first fuel injection in preparation of the first ignition at the start.

Also, in the conventional engine starting device disclosed in Japanese Patent Application Laid-Open Publication No. 2002-332938, a starter motor is reversely driven to reversely rotate a crankshaft when a start command is given, but in the conventional starting device, an object of once reversely rotating the crankshaft at the start of the engine is to increase a run-up distance.

On the other hand, in the present invention, the crankshaft is first reversely rotated when the start command is given so that the air/fuel mixture is taken into the cylinder that is first ignited when cranking for successive forward rotation of the crankshaft is performed, rather than increasing a run-up distance. Specifically, in the present invention, the crankshaft is first reversely rotated at the start for injecting fuel in preparation for the first ignition after the start operation. Thus, the engine starting device according to the present invention and the conventional engine starting device have completely different objects of reversely rotating the crankshaft at the start.

As described above, if the crankshaft is reversely rotated to the position at a midpoint in the intake stroke during forward rotation or the position corresponding to before the intake stroke to cause the fuel injection device to perform the first fuel injection, the start time injection performance determining means determines that the first fuel injection at the start is performed, and the timer means 63 starts measurement of the elapsed time from the time when the first fuel injection is performed (the elapsed time after the first fuel injection).

Figure 6:
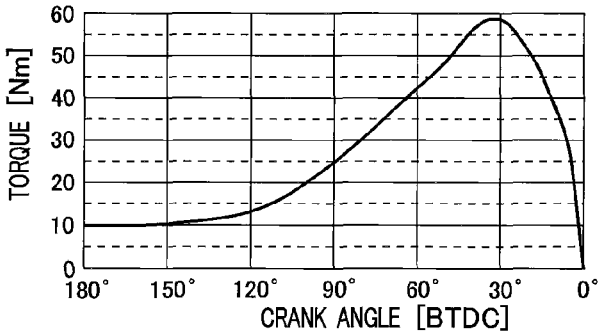
FIG. 6 is a graph showing an example of a relationship between load torque of the engine and a crank angle.
Figure 7:
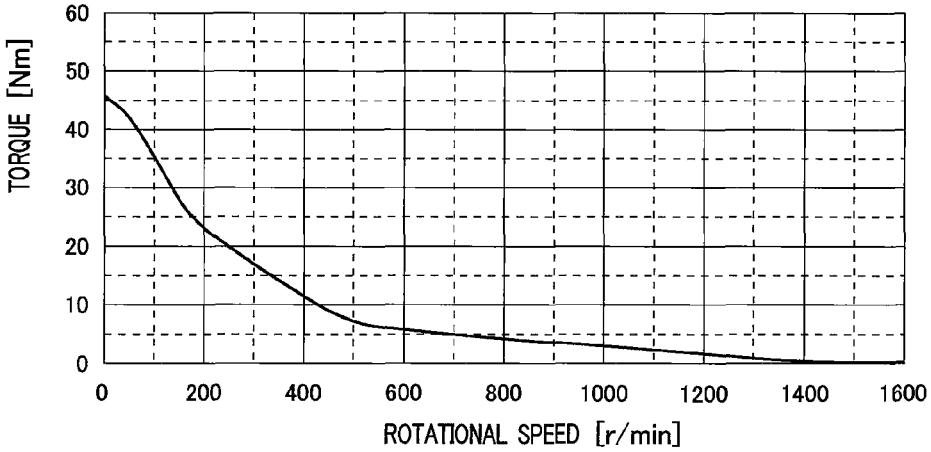
FIG. 7 is a graph showing an example of a relationship between output torque of a starter motor and a rotational speed.

After the first fuel injection at the start, the starter motor SG is driven forward. A relationship between the load torque of the engine and the crank angle at this time is as shown in FIG. 6, and a relationship between the output torque of the starter motor and the rotational speed is as shown in FIG. 7. In FIG. 6, the crank angle on the axis of abscissa indicates an angle before the top dead center [BTDC], and the shown crank angle position at 0° is a crank angle position corresponding to the top dead center of the piston (referred to as a top dead center position).

When the starter motor is driven forward, the output torque of the motor is reduced with increasing rotational speed as shown in FIG. 7, while the load torque of the engine is increased as the crankshaft is rotated toward the top dead center position as shown in FIG. 6. If the engine has high friction torque and cannot be accelerated to a rotational speed for obtaining sufficient inertial energy for the piston to exceed the top dead center of the compression stroke, the crankshaft once stops at a midpoint in the compression stroke. In the conventional starting device, the driving of the starter motor is stopped at this time, while in the embodiment, energization to the starter motor is maintained even after the stop of the starter motor to continuously drive the starter motor forward while controlling the output torque of the motor at a maximum value within a range equal to or lower than an upper limit value of the driving current (armature current).

Generally, in a four cycle engine, a slight compression leak occurs from a piston ring or intake and exhaust valves in the process of the piston being moved up toward the top dead center of the compression stroke, and thus if the starter motor continuously drives the crankshaft still after the stop of the crankshaft, the compression torque is reduced with time to gradually reduce the load torque of the engine. Thus, if the starter motor is continuously driven even after the starter motor cannot overcome the load torque (the sum of compression torque and friction torque) of the engine and is stopped, the piston is slowly moved up with gradual reduction in the load torque by the compression leak, and the crankshaft is rotated at a low speed. When the rotational angle position of the crankshaft exceeds a maximum compression torque position (a position around 300 before the top dead center of the compression stroke in the example in FIG. 7) before the crank angle position (the 0° position) corresponding to the top dead center of the compression stroke, the load torque of the engine is reduced, and the load applied from the engine to the starter motor is reduced, thereby causing the crankshaft to start rotation at a higher speed. Thus, the piston can easily exceed the top dead center of the compression stroke.

In the conventional engine starting device, the first ignition at the start is performed in a position before the top dead center of the compression stroke during forward rotation, while in the embodiment, the crankshaft is rotated at the low speed so as to exceed the top dead center of the compression stroke. Thus, if the first ignition is performed in the crank angle position advanced from the top dead center, the piston may be pushed back to reversely rotate the engine.

Thus, in the embodiment, the first ignition at the start of the engine is performed at a crank angle position where the piston reaches the top dead center of the compression stroke, or a position passing by a certain angle (for example, 10°) through the crank angle position corresponding to the top dead center of the piston (an initial crank angle position of the expansion stroke during forward rotation).

When the first ignition at the start of the engine is performed at the crank angle position where the piston reaches the top dead center of the compression stroke, or the position passing by a certain angle (for example, 10°) through the crank angle position corresponding to the top dead center of the piston, the fuel in the ignited cylinder can be burned to perform the expansion stroke while preventing the piston from being pushed back. Thus, the crankshaft is sharply accelerated and rotated by the resultant force of a driving force of the starter motor and a rotating force caused by combustion (explosion) in the cylinder. The rotation causes inertial energy to be sharply accumulated to perform a compression stroke of the next cylinder, and then ignition is performed in the cylinder to perform the expansion stroke. Thereafter, injection of fuel and ignition are repeatedly performed so that each cylinder performs a combustion cycle, thereby increasing the rotational speed of the crankshaft to complete the start of the engine.

Figures 8A, 8B, 8C:
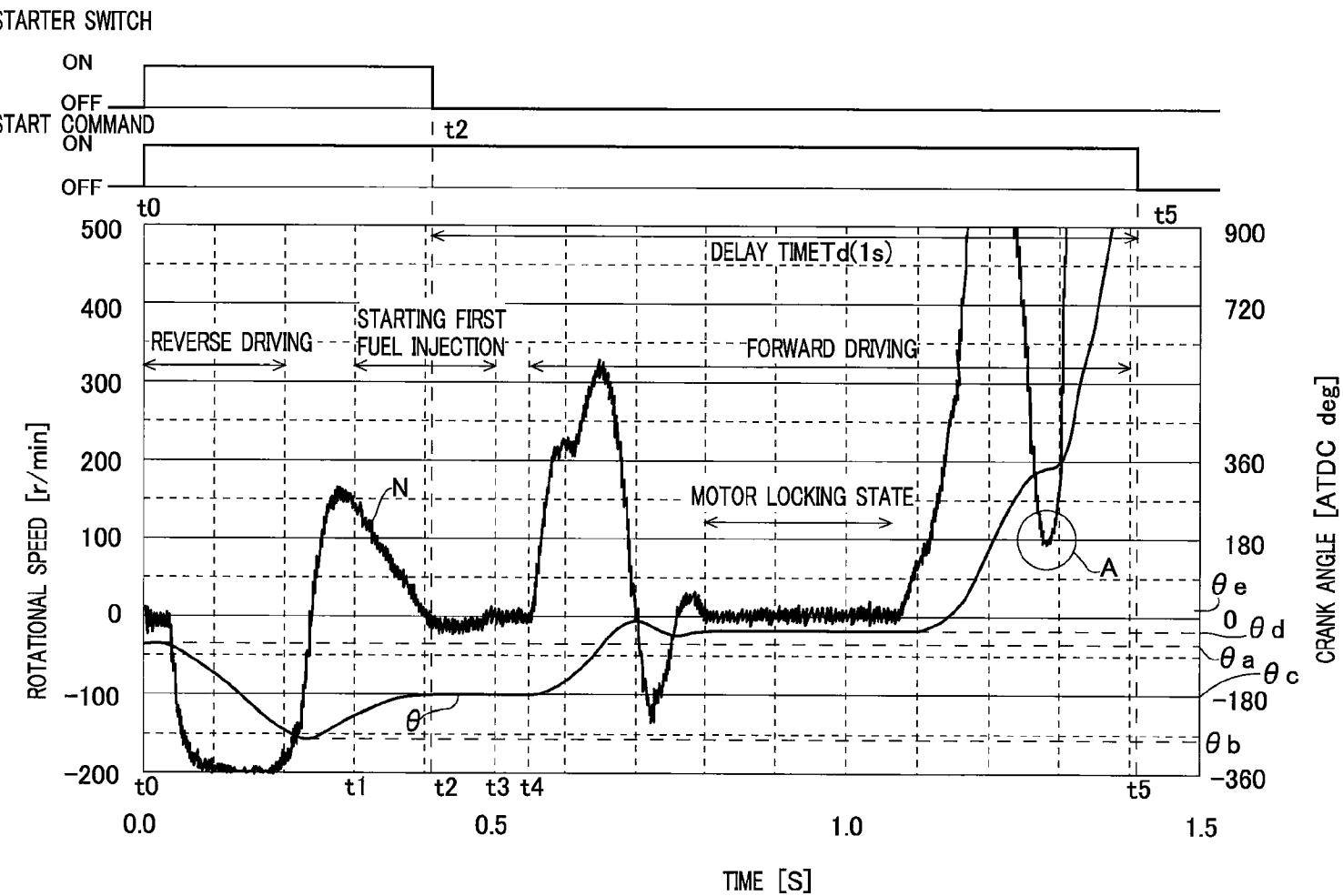
FIGS. 8A to 8C are graphs showing a state where a rotational speed of a crankshaft changes with changes in crank angle at the start of the engine in an embodiment of the present invention.

FIG. 8C shows a relationship between a rotational speed N of the crankshaft and a crank angle θ at the start measured in an experiment by the inventor. In the example in FIG. 8C, the engine stops in a state where the piston of the second cylinder of the engine is in a crank angle position θa near the bottom dead center of the compression stroke during forward rotation. When a start command (FIG. 8B) is given at time t0, the start reverse rotation drive mode switching means 53 switches the control mode to the start reverse rotation drive mode, and thus the starter reverse rotation drive means 54 reversely drives the starter motor SG to reversely rotate the crankshaft. Thus, the crankshaft is rotated from the crank angle position corresponding to the bottom dead center of the compression stroke of the second cylinder toward the section corresponding to the intake stroke of the second cylinder during forward rotation. When the crank angle position enters the section corresponding to the intake stroke of the second cylinder during forward rotation, in the first cylinder, the crankshaft enters the section corresponding to the expansion stroke during forward rotation, and thus high load torque is applied from the first cylinder to the crankshaft. Thus, the crankshaft can be rotated only to a crank angle position θb at a midpoint in the section corresponding to the intake stroke of the second cylinder during forward rotation, and stops at this crank angle position. This crank angle position θb is a reverse rotation driving finish position. In the embodiment, it is determined that the crank angle position reaches a forward rotation drive start position θb when the reverse rotation drive time determining means 55 determines that the elapsed time from the time when the reverse driving is started exceeds the set delay time, or when the reverse time crank angle position determining means 56 determines that the crank angle position matches a preset crank angle position θb.

When it is determined that the crank angle position reaches the reverse rotation driving finish position θb, the driving of the starter motor is stopped to ensure an injector driving voltage, and then the fuel injection control means 60 gives an injection command to the injector drive circuit 42 at time t1 to cause the injector to perform first fuel injection in preparation for first ignition after the forward rotation of the crankshaft.

The driving of the starter motor is stopped during this time (time before the start of forward driving at time t4), and thus the crankshaft is pushed back by compression reaction of the first cylinder, moved to a shown position θc and stopped. After the first fuel injection from the injector is finished at time t3, the start forward rotation drive mode switching means 57 switches the control mode to the start forward rotation drive mode at time t4, and thus the starter forward rotation drive means 58 starts the forward driving of the starter motor SG and the start time ignition control means 59 simultaneously starts detection of the ignition position at the start.

When the starter forward rotation drive means 58 drives the starter motor forward from the position θc, and the crank angle position approaches the top dead center position (0° position) of the compression stroke of the second cylinder, the load torque applied to the crankshaft is increased to reduce the rotational speed, and the crankshaft is pushed back at a crank angle position before a crank angle position where the load torque (compression reaction of the second cylinder) is maximum, and stopped at a position θd. If the driving current is continuously supplied to the starter motor to continuously drive the motor forward, the compression leak of the second cylinder gradually reduces the load torque applied to the crankshaft, and thus the crankshaft again starts forward rotation, and is accelerated when the crank angle position passes through the maximum load torque position before the top dead center position (0° position) of the compression stroke of the second cylinder.

In the embodiment, the position θe where the crank angle position passes by 10° through the top dead center of the second cylinder is the ignition position at the start, the ignition position is detected by the start time ignition control means 59, and when the ignition position is detected, the first ignition is performed in the second cylinder. The ignition causes the air/fuel mixture to be burned in the second cylinder to perform the expansion stroke, and thus the rotational speed of the crankshaft is sharply accelerated. When the crankshaft is rotated by 180° from the top dead center (0° position) of the compression stroke of the second cylinder, the first cylinder enters the compression stroke to increase the load torque applied to the crankshaft. The increase in the load torque reduces the rotational speed of the crankshaft, but the combustion in the second cylinder causes the inertial energy to be sufficiently accumulated, and thus the crankshaft does not stop before the top dead center of the compression stroke of the first cylinder. In the embodiment, the first ignition of the first cylinder is performed at the crank angle position passing by 10° through the top dead center of the compression stroke of the first cylinder. In FIG. 8C, a drop in the rotational speed N at a point A results from the influence of the compression stroke of the first cylinder.

When the friction torque is high, the crankshaft may stop before the top dead center of the compression stroke of the first cylinder, but in such a case, the starter forward rotation drive means 58 continuously drives the starter motor, and thus the crankshaft can be again rotated with gradual reduction in the load torque by the compression leak, thereby allowing the ignition of the first cylinder to be performed without problems.

As described above, the ignition in the second cylinder and the first cylinder is repeated to gradually increase the rotational speed of the engine, and the engine can eventually maintain rotation even if the driving of the starter motor is stopped, and the start of the engine is completed. When the start completion determining means 61 determines that the start of the engine is completed, the starter drive stopping means 62 stops the driving of the starter motor SG. At this time, the normal operation mode switching means 67 switches the control mode to the normal operation mode, and thus the normal operation time control means 68 shifts control of the ignition device and the fuel injection device to control during normal operation.

Whether the engine can rotate by itself (whether the start of the engine is completed) can be determined by confirming that the crankshaft has rotated a set number of times at an average rotational speed higher than a preset start determination value.

In the above control, information on the crank angle position of the engine is required for determining whether the rotational angle position of the crankshaft reaches a target reverse driving stop position θb when the starter motor is reversely rotated. The information on the crank angle position is also required for detecting the ignition position θe at the start. Further, the information on the crank angle position of the engine is also required for detecting the crank angle position where fuel injection to each cylinder is performed. In the control during normal operation, the information on the crank angle position of the engine is required for detecting the arithmetically operated ignition position and determining a fuel injection start position.

In the conventional engine control device, crank angle information of an engine is often obtained from outputs of a signal generator that detects a reluctor provided on a rotor that rotates with the engine and generates pulse signals. Such a signal generator cannot generate pulses with a high peak value when a rotational speed of the crankshaft is low, and is thus unsuitable as a signal source for obtaining crank angle information during extremely low speed rotation (for example, at 200 r/min or less) of the engine.

Thus, in the embodiment, the crank angle information is basically obtained from the detection signals output from the three-phase Hall sensors 29*u* to 29*w* provided in the starter generator SG, and the output pulse of the signal generator 28 is used only for identifying which of the crank angle positions of the engine the rotational angle position detected from the output of the Hall sensors corresponds to.

Figures 9A, 9B, 9C, 9D, 9E:
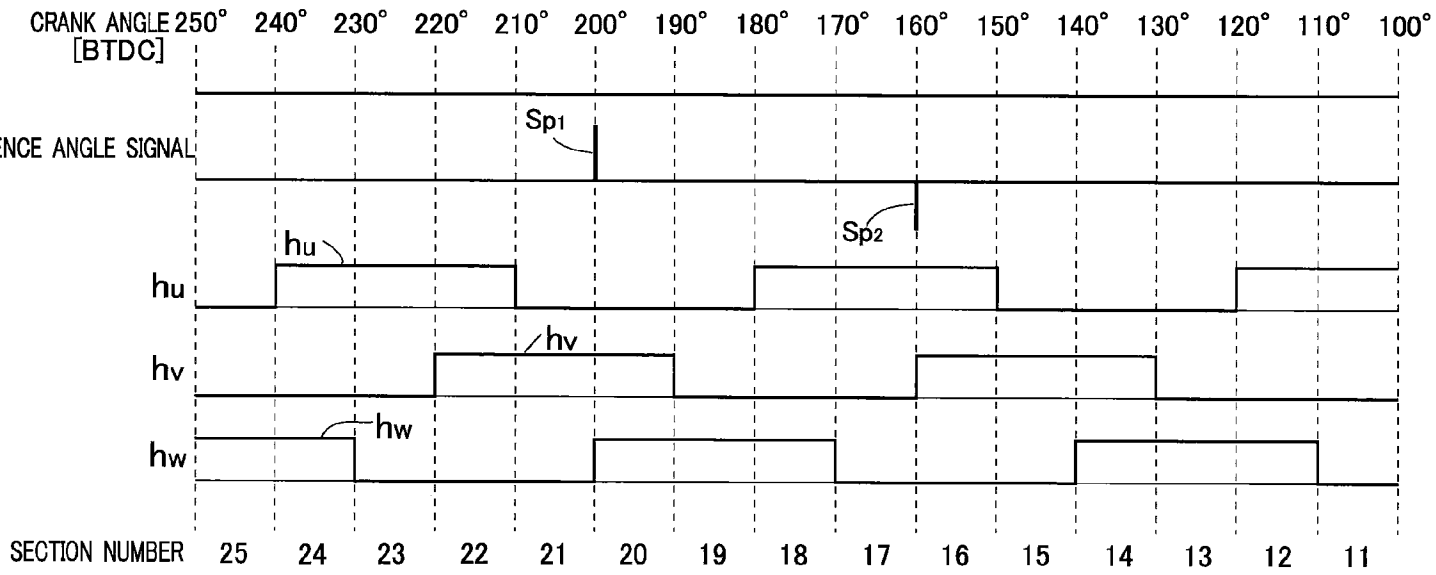
FIGS. 9A to 9E are schematic waveform charts showing waveforms of output pulses of a signal generator and waveforms of output signals of Hall sensors used in the embodiment of the present invention.

In the case where a 12-pole (6 pairs of poles) magneto rotor is used as the rotor of the rotating electric machine, when Hall ICs are used as the three-phase Hall sensors 29*u* to 29*w*, waveforms of the position detection signals hu to hw generated by the sensors 29*u* to 29*w* are as shown in FIGS. 9C to 9E, and any of the position detection signals hu to hw changes from a high level (H level) to a low level (L level) or from the low level to the high level for every 10° change of the crank angle. In the embodiment, the H level and the L level of the position detection signals hu to hw are indicated by "1" and "0", a series of sections are detected, with a 10° section as one section, from changes in level pattern of the position detection signal, and it is identified which crank angle positions of the engine these sections correspond by using the output pulse of the signal generator 28.

In the embodiment, the signal generator 28 detects the reluctor r to generate a pulse in a section where the piston is positioned near the bottom dead center and the load torque of the engine is relatively low so that the signal generator 28 can generate a pulse with as high peak value as possible at the start. Specifically, as shown in FIG. 9B, the signal generator 28 is placed so that the signal generator 28 detects a leading edge and a trailing edge in the rotational direction of the reluctor r to generate a pulse Sp1 having a positive polarity and a pulse Sp2 having a negative polarity at positions of 200° and 160° before the top dead center of the compression stroke of the second cylinder.

It is identified which of the crank angle positions of the engine the series of sections detected by changes in output pattern of the Hall sensors, from the pulses Sp1 and Sp2 output by the signal generator 28. In the shown example, as indicated at the bottom in FIG. 9, a section of 10° (a section from a position where the pattern of the position detection signals hu, hv, hw is 0, 1, 1 to a position where the pattern is 0, 0, 1) detected immediately after the signal generator 28 generates the pulse Sp1 is denoted by a section number "20", and thereafter the section number is incremented or decremented by one for every change in the output pattern of the Hall sensors, and 72 sections detected during two turns of the crankshaft are denoted by section numbers 1 to 72.

If a relationship between the series of sections detected from the changes in the output pattern of the Hall sensors and the present crank angle position of the engine can be once identified, thereafter the section number can be incremented or decremented for every change in the output pattern of the Hall sensor to maintain the relationship between each section and the crank angle position of the engine.

In the engine starting device of the embodiment, in the case where the starter switch SW is once turned on and then turned off before the first fuel injection at the start, the start command is cancelled immediately when the switch state monitoring means 51 detects that the starter switch is turned off. When the start command is cancelled, the starter drive stopping means 59 stops driving of the starter motor. When the starter switch that has been once turned on is turned off before the first fuel injection, the air/fuel mixture has not taken into the cylinder of the engine, and thus stopping the starter motor immediately when the starter switch is turned off has no influence on the next start of the engine.

On the other hand, when the starter switch is turned off (for example, when the starter switch is turned off at the time t2 in FIG. 8C) after the first fuel injection, stopping the starter motor immediately when the starter switch is turned off causes the air/fuel mixture to remain in the cylinder of the engine, and thus the air/fuel mixture in the cylinder becomes too concentrated at the next start of the engine, thereby reducing startability.

In order to prevent this, in the present invention, the starter motor is continuously driven forward during the set delay time Td (1 sec in the example in FIG. 8) when the starter switch is turned off after the first fuel injection at the start (at the time t2), and stopped at time t5.

Thus, in the embodiment, when the starter switch state monitoring means 51 detects that the starter switch is turned off, the elapsed time determining means 65 determines whether the elapsed time (the elapsed time from the time when the first fuel injection is performed) measured by the timer means 63 reaches the set delay time.

When it is determined that the elapsed time has not reach the set delay time, as shown in FIG. 8B, the start command is continuously issued to continuously drive the starter motor. When the elapsed time determining means 65 determines that the elapsed time reaches the set delay time Td at the time t5, the start command control means 66 cancels the start command, and thus the starter drive stopping means 62 stops the driving of the starter motor.

The delay time Td is set to time equal to or longer than time required for the cylinder into which the air/fuel mixture is taken by the first fuel injection to perform at least one exhaust stroke. The start time ignition control means 59 is comprised so as not to ignite the engine when the starter switch state monitoring means 51 detects that the starter switch is turned off, and the fuel injection control means 60 is comprised so as not to inject fuel even if the start command is issued after the starter switch state monitoring device 51 detects that the starter switch is turned off.

Thus, when the starter switch is turned off after the first fuel injection, the driving of the starter motor is not immediately stopped, but the starter motor is continuously driven during the set delay time and then stopped. This prevents the fuel from being accumulated in the cylinder, thus prevents the inside of the cylinder from becoming wet with the fuel to make the next start of the engine difficult.

Figure 10:
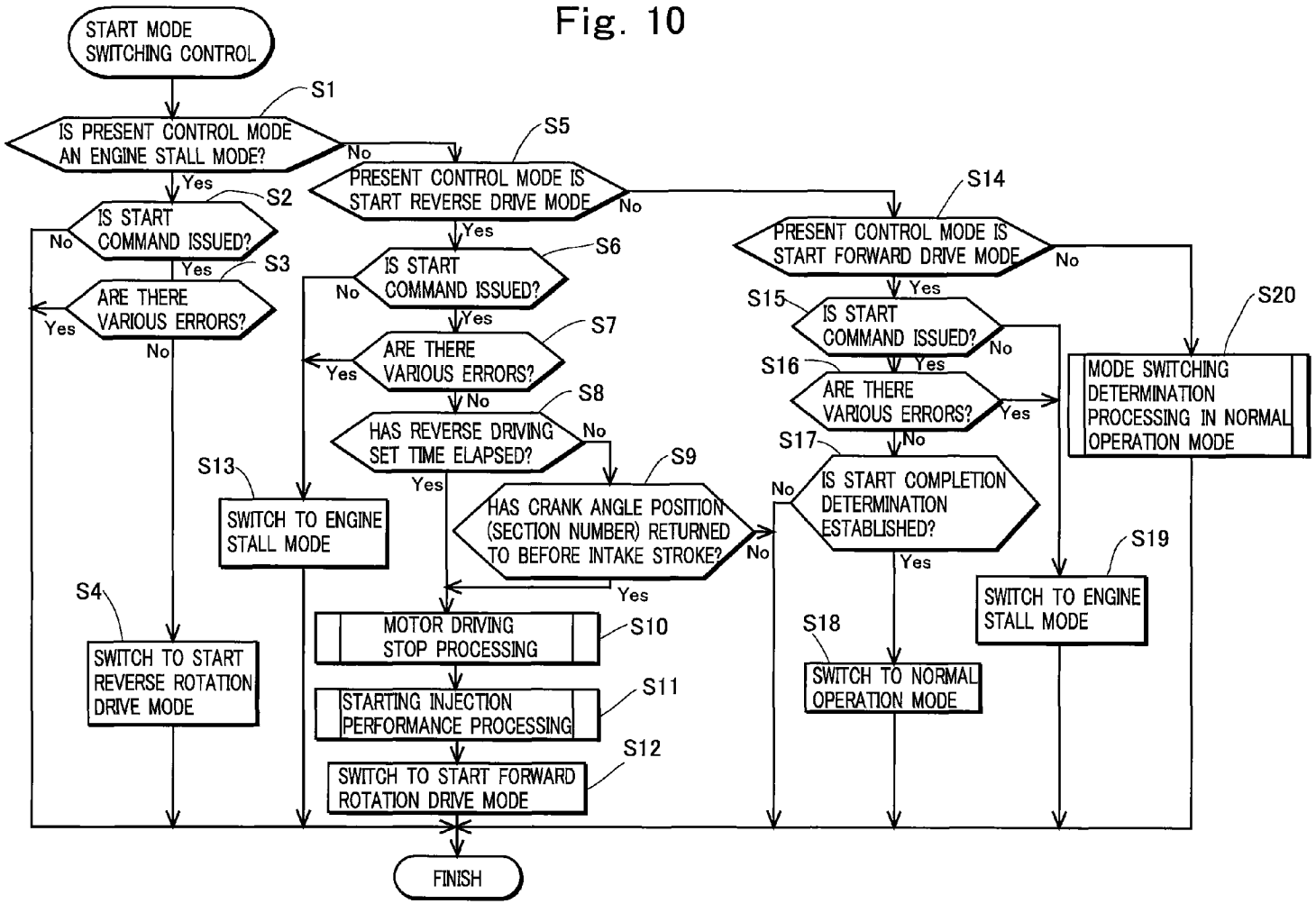
FIG. 10 is a flowchart of an algorithm of a control mode switching processing performed by a microprocessor in the embodiment of the present invention.

FIG. 10 is a flowchart of an algorithm of a task processing performed by the microprocessor for controlling switching of the control mode in the shift from the start to the normal operation state in the control device in FIG. 3.

The microprocessor repeatedly performs the task processing in FIG. 10 at short time intervals at power-on of the microprocessor to control switching of the control mode. According to the shown algorithm, first in Step S1, it is determined whether the present control mode is a control mode at the stop of the engine (an engine stall mode). When it is determined that the present control mode is the engine stall mode, then in Step S2, it is determined whether a start command is issued. When it is determined that the start command is not issued, this processing is finished without performing any processing thereafter. When it is determined that the start command is issued, the process moves to Step S3, and it is checked whether there are various errors (such as abnormality of sensors). When it is determined that there is an error, this processing is finished without performing any processing thereafter. When it is determined that there is no error, in Step S4, the control mode is switched to the start reverse rotation drive mode, and this task is finished. The microprocessor operates the rotating electric machine SG as a brushless motor, and controls energization to the three-phase armature coils of the rotating electric machine SG so as to reversely rotate a rotor thereof, by a different task processing started when the control mode is switched to the start reverse rotation drive mode.

When it is determined in Step S1 in the task in FIG. 10 that the present control mode is not the engine stall mode, the process moves to Step S5, and it is determined whether the present control mode is the start reverse rotation drive mode. When it is determined that the present control mode is the start reverse rotation drive mode, it is determined in Step S6 whether the start command is given. When it is determined that the start command is given, the process moves to Step S7, and it is determined whether there are various errors. When it is determined that there is no error, in Step S8, it is determined whether a set time has elapsed after the start of the reverse driving of the starter motor. When it is determined in Step S8 that the set time has not elapsed after the reverse driving, it is determined in Step S9 whether the present crank angle position (section number) has returned to the reverse rotation driving finish position θb set in a position at a midpoint in a section corresponding to the intake stroke during forward rotation, or a position corresponding to the position before the start of the intake stroke during forward rotation. When it is determined that the present crank angle position has not returned to the reverse rotation driving finish position, this processing is finished without performing any processing thereafter.

When it is determined in Step S8 that the set time has elapsed after the reverse driving, and it is determined in Step S9 that the present crank angle position is the reverse rotation driving finish position, the process moves to Step S10, and the driving of the starter motor SG is stopped. After the driving of the starter motor is stopped to ensure a driving voltage of the injector, Step S11 is performed, and the first fuel injection is performed in preparation for the first ignition at the start. Then in Step S12, the control mode is switched to the start forward rotation drive mode, and this task is finished.

Start injection performance processing for performing first fuel injection for the start in Step S11 is performed by a different task processing started when it is determined in Step S8 that the set time has elapsed after the reverse driving and when it is determined in Step S9 that the present crank angle position is the reverse rotation driving finish position.

When the control mode is switched to the start forward rotation drive mode in Step S12, an unshown task processing is started for controlling energization to the armature coil so as to rotate forward the rotor of the rotating electric machine SG, and the starter motor is driven forward. When it is determined in Step S6 that the start command is not given, and when it is determined in Step S7 that there is an error, the process moves to Step S13, and the control mode is switched to the engine stall mode. When the control mode is switched to the engine stall mode, an unshown task is started to perform a series of processings required for maintaining the engine in a stop state such as a stop of driving of the starter motor or prohibition of issuing the ignition command and the injection command.

When it is determined in Step S5 that the present control mode is not the start reverse rotation drive mode, the process proceeds to Step S14, and it is determined whether the present control mode is the start forward rotation drive mode. When it is determined that the control mode is the start forward rotation drive mode, it is determined in Step S15 whether the start command is given. When it is determined that the start command is given, it is determined in Step S16 that there are various errors. When it is determined that there is no error, it is determined in Step S17 whether the start completion determination is established. When it is determined that the start completion determination is established, in Step S18, the control mode is switched to the normal operation mode, and this task is finished.

When it is determined in Step S15 that the start command is not given or it is determined in Step S16 that there are various errors, the process proceeds to Step S19, and the control mode is switched to the engine stall mode. When it is determined in Step S14 that the present control mode is not the start forward rotation drive mode, the process proceeds to Step S20, and the control mode is switched in the normal operation mode.

In the normal operation mode, a processing for closing the decompression valve 116 and a processing for constructing normal time fuel injection control means and normal time ignition control means for controlling the fuel injection device and the ignition device, respectively, are performed by different task processings from the processing in FIG. 10. The fuel injection control means arithmetically operates a fuel injection amount required for obtaining a predetermined air/fuel ratio relative to various control conditions, and gives, to the injector drive circuit 42, an injection command having a signal width required for injecting the arithmetically operated amount of fuel at any injection start position such as a crank angle position immediately before the start of the intake stroke. The normal time ignition control means comprises ignition position arithmetical operation means for arithmetically operating an ignition position of the engine relative to various control conditions, and means for detecting the arithmetically operated ignition position, and gives an ignition command signal to the ignition circuit to cause an ignition operation when the ignition position arithmetical operation means detects the arithmetically operated ignition position. The ignition position arithmetical operation means arithmetically operates time required for the crankshaft to rotate from a predetermined reference crank angle position to the ignition position at the present rotational speed, as ignition position detecting clocking data. When the predetermined reference crank angle position (section number) is detected, measurement of the arithmetically operated ignition position detecting clocking data is started, and when the measurement of the clocking data is completed, the ignition command signal is provided to the ignition circuit 41 to perform the ignition operation. Also, the driving voltage Visc is supplied from the ISC valve drive circuit 43 to the ISC valve 120 so as to maintain a constant idling speed of the engine to control the ISC valve.

Figure 11:
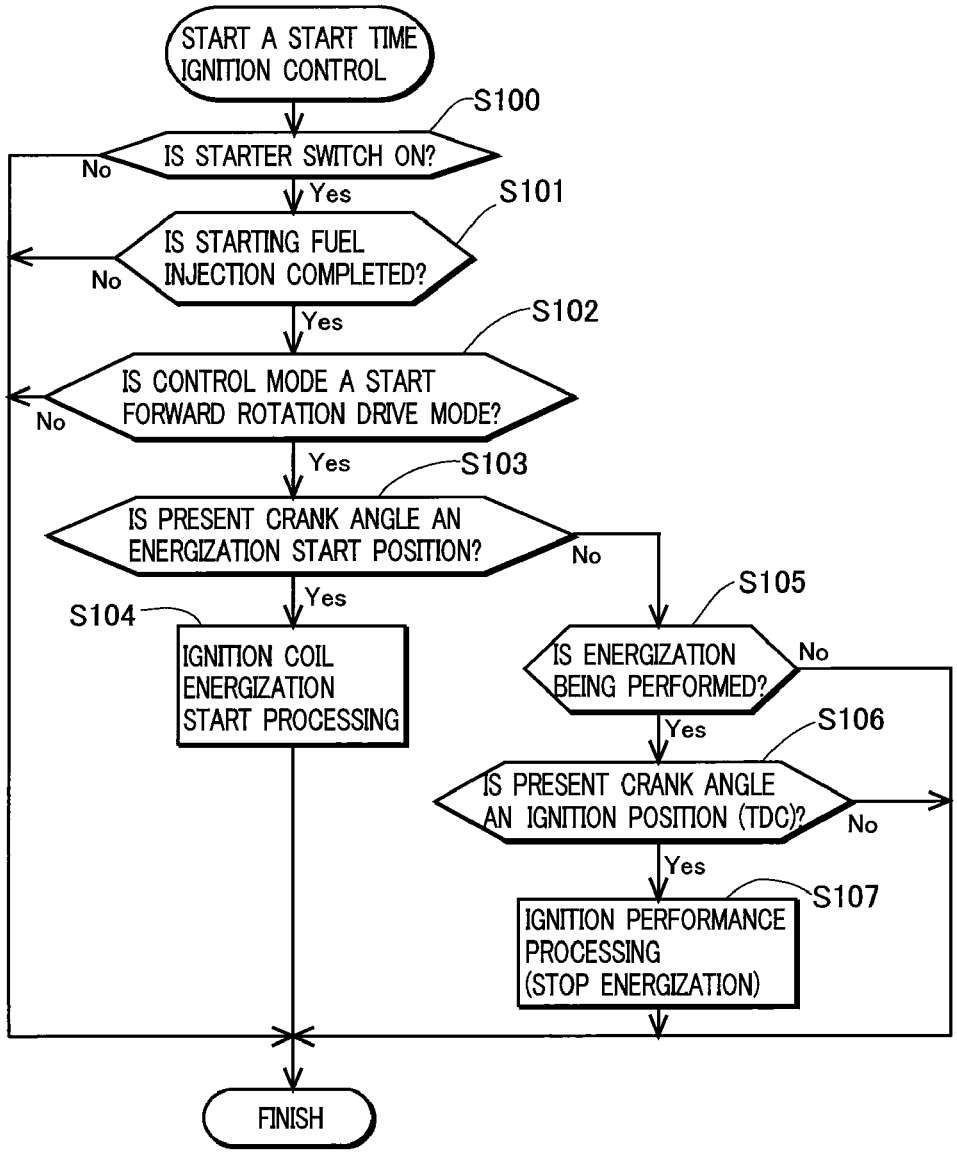
FIG. 11 is a flowchart of an algorithm of a start time ignition control processing performed by the microprocessor in the embodiment of the present invention.

When the control mode is switched to the start forward rotation drive mode in Step S12 in FIG. 10, an interruption processing in FIG. 11 is permitted, and the interruption processing in FIG. 11 is performed for every change in patterns of the output signals of the Hall sensor 29*u* to 29*w* (for every change in section number). The interruption processing in FIG. 11 detects a crank angle position corresponding to the top dead center of the compression stroke or a crank angle position slightly delayed from the top dead center of the compression stroke as an ignition position at the start, and an ignition operation at the start is performed at the ignition position.

In the interruption processing in FIG. 11, first in Step S100, it is determined whether the starter switch is on. When it is determined that the starter switch is not on, this processing is finished without performing any processing thereafter. When it is determined in Step S100 that the starter switch is on, then in Step S101, it is determined whether starting fuel injection is completed. When it is determined that the starting fuel injection is not completed, this processing is finished without performing any processing thereafter. When it is determined that the starting fuel injection is completed, the process proceeds to Step S102, and it is determined whether the control mode is the start forward rotation drive mode. When it is determined that the control mode is not the start forward rotation drive mode, this processing is finished without performing any processing thereafter. When it is determined that the control mode is the start forward rotation drive mode, the process proceeds to Step S103, and it is determined whether the present crank angle position (section number) is an energization start position where energization to the ignition coil 13 is started. When it is determined that the present crank angle position is the energization start position, the process proceeds to Step S104, energization to a primary coil of the ignition coil 13 is started, and this processing is finished. When it is determined in Step S103 that the present crank angle position (section number) is not the energization start position, the process moves to Step S105, and it is determined whether energization to the primary coil of the ignition coil is performed. When it is determined that the energization is not performed, this processing is finished without performing any processing thereafter. When it is determined that the energization is performed, the process moves to Step S106, and it is determined whether the present crank angle position is the ignition position at the start (in this example, the top dead center TDC of the compression stroke). When it is determined in Step S106 that the present crank angle position is not the ignition position at the start, this processing is finished without performing any processing thereafter. When it is determined that the present crank angle position is the ignition position at the start, an ignition performance processing in Step S107 is performed. In the ignition performance processing in Step S107, the energization to the primary coil of the ignition coil 13 is stopped to induce a high voltage for ignition in a secondary coil of the ignition coil, thereby causing spark discharge in an ignition plug to ignite the engine.

In the embodiment, the start reverse rotation drive mode switching means 53 is constructed in Steps S1 to S4 in FIG. 10, and the reverse rotation drive time determining means 55 and the reverse time crank angle position determining means 56 are constructed in Steps S8 and S9. The fuel injection control means 60 is constructed in Step S11, and the start forward rotation drive mode switching means 57 is constructed in Step S12. Further, the start completion determining means 61 is constructed in Step S17, and the normal operation mode switching means 67 is constructed in Step S18. The engine stall mode switching means 69 is constructed in Steps S1 to S3, S13, S14 to S16 and S19 in FIG. 10, and the start time ignition control means 59 is constructed by the processing in FIG. 11.

Figure 12:
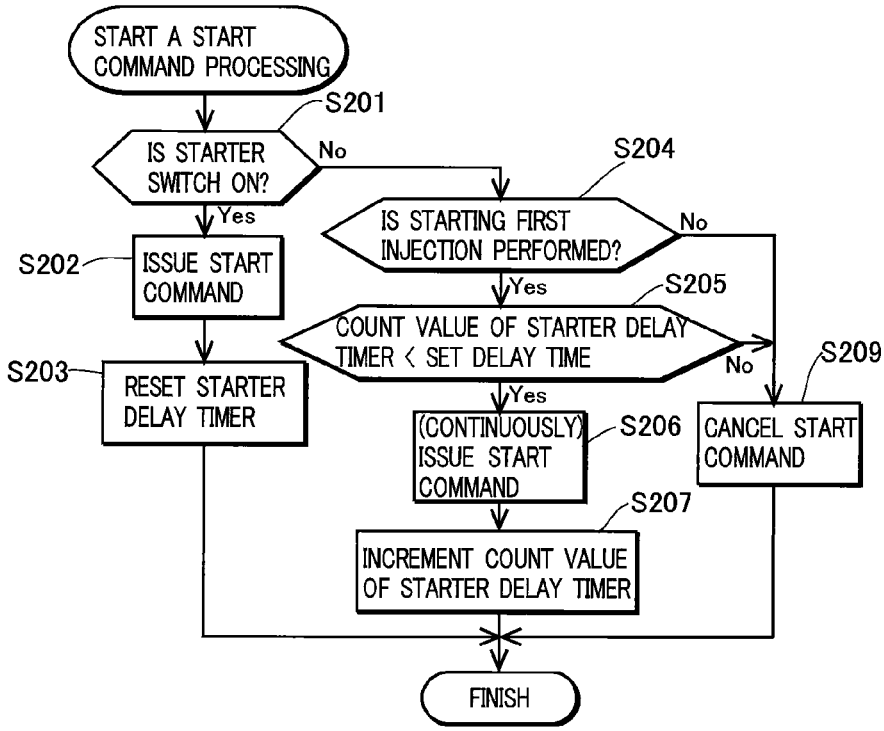
FIG. 12 is a flowchart of an example of an algorithm of a processing performed by the microprocessor for controlling issuing and canceling of a start command in the embodiment of the present invention.

FIG. 12 shows an algorithm of a task of a processing for controlling issuing and canceling of the start command. This task is also repeatedly performed at short time intervals. When the task in FIG. 12 is started, it is determined in Step S201 whether the starter switch is on. When it is determined that starter switch is on, the start command is issued in Step S202, and then a starter delay timer that measures a delay time is reset in Step S203, and this processing is finished.

When it is determined in Step S201 that the starter switch is off, it is determined in Step S204 whether the first fuel injection at the start is performed. When it is determined that the first fuel injection is performed, it is determined in Step S205 whether a count value of the starter delay timer is shorter than the set delay time. When it is determined in Step S205 that the count value of the starter delay timer is shorter than the set delay time, the start command is continuously issued in Step S206, the count value of the starter delay timer is incremented in Step S207, and then this processing is finished.

When it is determined in Step S204 that the first fuel injection is not performed and when it is determined in Step S205 that the count value of the starter delay timer is the set delay time or longer, the process moves to Step S209, and the start command is canceled, then in Step S208, the control mode is switched to the engine stall mode to prohibit ignition of the engine and fuel injection, and then this processing is finished.

According to the algorithm in FIG. 12, the starter switch state monitoring means 51 in FIG. 3 is constructed in Step S201, and the start time injection performance determining means 64 is constructed in Step S204. The timer means 63 is comprised of the starter delay timer and constructed in Step S203 and S207, and the elapsed time determining means 65 is constructed in Step S205. Further, the start command issuing and canceling control means 52 is constructed in Steps S202, S206 and S209.

In the embodiment, the starter switch state monitoring means 51, the start time fuel injection performance determining means 64, and the elapsed time determining means 65 for determining whether the elapsed time measured by the timer means 63 reaches the set delay time are provided, and the start command issuing and canceling control means is comprised so as to issue the start command when the starter switch state monitoring means 51 determines that the starter switch is on, continuously issue the start command when the starter switch state monitoring means 51 determines that the starter switch is off, the start time fuel injection performance determining means 64 determines that the first fuel injection is performed, and the elapsed time determining means 65 determines that the elapsed time has not yet reached the set delay time, and cancel the start command when the starter switch state monitoring means 51 determines that the starter switch is off, and the start time fuel injection performance determining means 64 determines that the first fuel injection is not performed, and when the starter switch state monitoring means 51 determines that the starter switch is off, the start time fuel injection performance determining means 64 determines that the first fuel injection is performed, and the elapsed time determining means 65 determines that the elapsed time reaches the set delay time. It may be allowed, however, that a rotation angle of the crankshaft is detected instead of measuring the elapsed time, and when the starter switch is turned off after the first fuel injection, the starter motor is continuously driven until the crankshaft of the engine is rotated forward by a set angle or more from the crank angle position where the first fuel injection is performed.

When comprised as described above, the timer means 63 is omitted in FIG. 3, the elapsed time determining means 65 is replaced by start time crankshaft rotation angle determining means for determining whether the crankshaft of the engine is rotated forward by a set angle a or more from the crank angle position where the first fuel injection is performed when the start time fuel injection performance determining means 64 determines that the first fuel injection is performed. The start command issuing and canceling control means 52 issues a start command when the starter switch state monitoring means 51 determines that the starter switch is on, continuously issues the start command when the starter switch state monitoring means 51 determines that the starter switch is off, and the start time crankshaft rotation angle determining means determines that the crankshaft is not rotated by the set angle a or more, and cancels the start command when the starter switch state monitoring means 51 determines that the starter switch is off, and the start time fuel injection performance determining means 64 determines that the first fuel injection is not performed, and when the starter switch state monitoring means 51 determines that the starter switch is off, the start time fuel injection performance determining means

64 determines that the first fuel injection is performed, and the start time crankshaft rotation angle determining means determines that the crankshaft is rotated by the set angle a or more. The set angle a is set to a rotation angle or more required for the cylinder into which the air/fuel mixture is taken by the first fuel injection when the starter motor is continuously driven forward to perform at least one exhaust stroke.

Specifically, in another aspect of an engine starting device according to the present invention, the engine starting device comprises: starter reverse rotation drive means 54 for reversely driving the starter motor for once reversely rotating the crankshaft when the start command for commanding to start the engine is issued; starter forward rotation drive means 58 for driving the starter motor forward so as to rotate the crankshaft forward after the driving of the starter motor by the starter reverse rotation drive means is finished; fuel injection control means 60 for causing a fuel injection device to perform first fuel injection at the start at a crank angle position within a crank angle range suitable for injecting fuel for generating an air/fuel mixture to be supplied into the cylinder of the engine in preparation for the first ignition at the start performed by an ignition device; start time ignition control means 59 for causing ignition at an ignition position suitable at the start of the engine in the process of forward rotation of the crankshaft by the starter forward rotation drive means; the start time fuel injection performance determining means 64 for determining whether the first fuel injection is performed when the starter switch state monitoring means determines that the starter switch is off, the start time crankshaft rotation angle determining means for determining whether the crankshaft of the engine is rotated forward by a set angle or more from the crank angle position where the first fuel injection is performed when the start time fuel injection performance determining means determines that the first fuel injection is performed; the starter switch state monitoring means 51 for monitoring the state of the starter switch that is turned on at the start of the engine; the start command issuing and canceling control means 52 for issuing the start command when the starter switch state monitoring means determines that the starter switch is on, continuously issuing the start command when the starter switch state monitoring means determines that the starter switch is off, and the start time crankshaft rotation angle determining means determines that the crankshaft is not rotated by the set angle or more, and canceling the start command when the starter switch state monitoring means 51 determines that the starter switch is off, and the start time fuel injection performance determining means 64 determines that the first fuel injection is not performed, and when the starter switch state monitoring means determines that the starter switch is off, the start time fuel injection performance determining means determines that the first fuel injection is performed, and the start time crankshaft rotation angle determining means determines that the crankshaft is rotated by the set angle or more; and starter drive stopping means 62 for stopping the driving of the starter motor when the start of the engine is completed and the start command is canceled.

The set angle is set to a rotation angle or more required for a cylinder into which the air/fuel mixture is taken by the first fuel injection to perform at least one exhaust stroke.

The crank angle position where the fuel injection control means causes the first fuel injection may be a predetermined position or a crank angle position where a reverse driving time of the starter motor reaches a set time.

The starter forward rotation drive means is preferably comprised so as to continuously drive the starter motor in a direction of starting the engine until the start of the engine is confirmed even when the crankshaft stops before a piston in the cylinder of the engine reaches a top dead center of a compression stroke.

Figure 13:
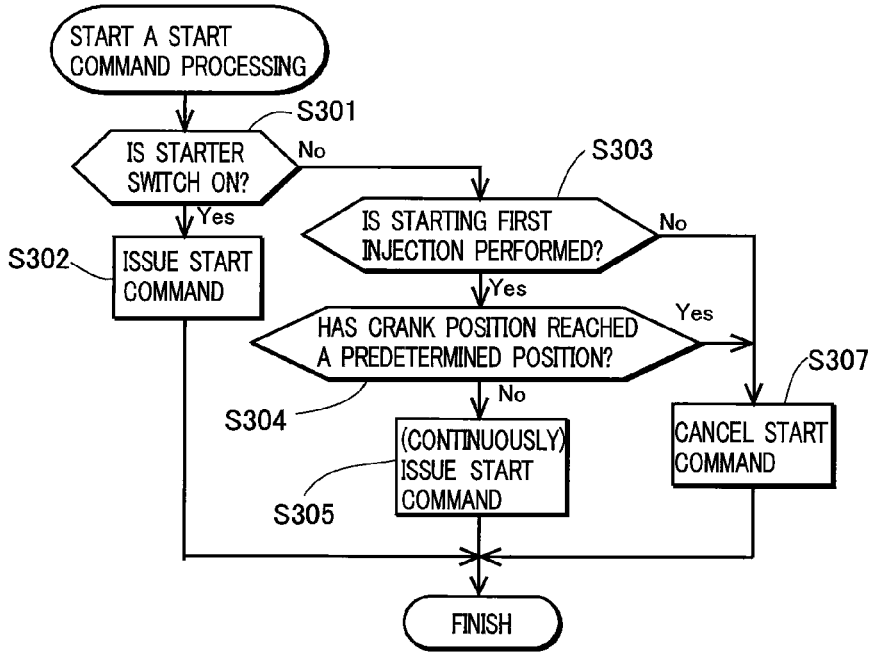
FIG. 13 is a flowchart of another example of an algorithm of a processing performed by the microprocessor for controlling issuing and canceling of a start command in the embodiment of the present invention.

FIG. 13 shows an algorithm of a task performed at short time intervals for controlling issuing and canceling of the start command when the start command issuing and canceling control means 52 is constructed as described above. When the task in FIG. 13 is started, it is determined in Step S301 whether the starter switch is on. When it is determined that starter switch is on, a start command is issued in Step S302, and then this process is finished.

When it is determined in Step S301 that the starter switch is off, it is determined in Step S303 whether first fuel injection at the start is performed. When it is determined that the first fuel injection is performed, it is determined in Step S304 whether the rotation angle of the crankshaft from the crank angle position where the first fuel injection is performed reaches a set angle. When it is determined that the rotation angle of the crankshaft has not reached the set angle, the start command is continuously issued in Step S305, and this processing is finished.

When it is determined in Step S303 that the first fuel injection is not performed and it is determined in Step S304 that the rotation angle of the crankshaft from the crank angle position where the first fuel injection is performed has reached the set angle, the process moves to Step S307, the start command is cancelled, and then this processing is finished.

According to the algorithm in FIG. 13, the starter switch state monitoring means is constructed in Step S301, and the start time injection performance determining means is constructed in Step S303. The start time crankshaft rotation angle determining means is constructed in Step S304 for determining whether the crankshaft of the engine is rotated forward by the set angle or more from the crank angle position where the first fuel injection is performed when the start time fuel injection performance determining means determines that the first fuel injection is performed, and the start command issuing and canceling control means is constructed in Steps S302, S305, and S307.

When comprised as described above, the rotation angle of the crankshaft of the engine can be easily recognized from the position detection signal in FIG. 9.

In the embodiment, the case of starting the parallel two cylinder four cycle engine is taken as the example, but the present invention may be of course applied to the case of starting a single cylinder four cycle engine or a multicylinder four cycle engine having three or more cylinders.

Although the preferred embodiment of the invention has been described and illustrated with reference to the accompanying drawings, it will be understood by those skilled in the art that it is by way of examples, and that various changes and modifications may be made without departing from the spirit and scope of the invention, which is defined only to the appended claims.

What is claimed is:

1. An engine starting method for starting an engine comprising at least one cylinder having a piston therein, a crankshaft connected to the piston in said cylinder, a fuel injection device that injects fuel for generating an air/fuel mixture to be supplied into said cylinder, an ignition device that ignites the air/fuel mixture compressed in said cylinder, and a starter motor that can rotationally drive said crankshaft forward and reversely, wherein said method comprises the steps of;

reversely driving said starter motor for once reversely rotating the crankshaft of said engine when the starter switch is turned on;

driving said starter motor so as to rotate said crankshaft forward after the reverse driving of said starter motor is finished;

causing said fuel injection device to perform first fuel injection at the start at a crank angle position within a crank angle range suitable for injecting fuel for generating the air/fuel mixture to be supplied into the cylinder of said engine in preparation for first ignition at the start performed by said ignition device;

causing said ignition device to perform the first ignition at the crank angle position suitable as an ignition position at the start of said engine in the process of forward rotation of said crankshaft;

immediately stopping the driving of said starter motor when said starter switch is turned off before said first fuel injection at the start; and continuously driving said starter motor forward until the cylinder into which the air/fuel mixture is supplied by said first fuel injection performs at least one exhaust stroke and then stopping the driving of said starter motor when said starter switch is turned off after said first fuel injection at the start.

2. The engine starting method according to claim 1, wherein the crank angle position where said first fuel injection is performed is a predetermined position.

3. The engine starting method according to claim 1, wherein the crank angle position where said first fuel injection is performed is a crank angle position when a reverse driving time of said starter motor reaches a set time.

4. The engine starting method according to claim 1, wherein in forward rotation of said crankshaft, the starter motor is continuously driven in a direction of starting the engine until the start of the engine is confirmed even when the crankshaft stops before the piston in the cylinder of the engine reaches a top dead center of the compression stroke.

5. The engine starting method according to claim 2, wherein in forward rotation of said crankshaft, the starter motor is continuously driven in a direction of starting the engine until the start of the engine is confirmed even when the crankshaft stops before the piston in the cylinder of the engine reaches a top dead center of the compression stroke.

6. The engine starting method according to claim 3, wherein in forward rotation of said crankshaft, the starter motor is continuously driven in a direction of starting the engine until the start of the engine is confirmed even when the crankshaft stops before the piston in the cylinder of the engine reaches a top dead center of the compression stroke.

7. An engine starting device for starting an engine comprising at least one cylinder having a piston therein, a crankshaft connected to the piston in said cylinder, a fuel injection device that injects fuel for generating an air/fuel mixture to be supplied into said cylinder, an ignition device that ignites the air/fuel mixture compressed in said cylinder, and a starter motor that can rotationally drive said crankshaft forward and reversely, wherein said device comprises:

starter reverse rotation drive means for reversely driving said starter motor for once reversely rotating the crankshaft of said engine when a command signal for commanding to start said engine is issued;

starter forward rotation drive means for driving said starter motor forward so as to rotate said crankshaft forward after the reverse driving of said starter motor is finished;

fuel injection control means for causing said fuel injection device to perform first fuel injection at the start at a crank angle position within a crank angle range suitable for injecting fuel for generating the air/fuel mixture to be supplied into the cylinder of said engine in preparation for first ignition at the start performed by said ignition device;

start time ignition control means for causing said ignition device to perform the first ignition at the crank angle position suitable as an ignition position at the start of said engine in the process of forward rotation of said crankshaft; and start command issuing and canceling control means for issuing said start command when a starter switch, which is turned on at the start of the engine, is turned on, immediately canceling said start command when said starter switch is turned off before said first fuel injection at the start, and continuously issuing said start command until the cylinder into which the air/fuel mixture is supplied by said first fuel injection performs at least one exhaust stroke and then canceling said start command when said starter switch is turned off after said first fuel injection at the start.

8. An engine starting device for starting an engine comprising at least one cylinder having a piston therein, a crankshaft connected to the piston in said cylinder, a fuel injection device that injects fuel for generating an air/fuel mixture to be supplied into said cylinder, an ignition device that ignites the air/fuel mixture compressed in said cylinder; and a starter motor that can rotationally drive said crankshaft forward and reversely, wherein said device comprises:

starter reverse rotation drive means for reversely driving said starter motor for once reversely rotating said crankshaft when a command signal for commanding to start said engine is issued;

starter forward rotation drive means for driving said starter motor forward so as to rotate said crankshaft forward after the driving of the starter motor by said starter reverse rotation drive means is finished;

fuel injection control means for causing said fuel injection device to perform first fuel injection at the start at a crank angle position within a crank angle range suitable for injecting fuel for generating the air/fuel mixture to be supplied into the cylinder of said engine in preparation for first ignition at the start performed by said ignition device;

start time ignition control means for causing said ignition device to perform the ignition at the crank angle position suitable as an ignition position at the start of said engine;

timer means for measuring an elapsed time from the time when said fuel injection control means causes the first fuel injection;

starter switch state monitoring means for monitoring a state of a starter switch that is turned on at the start of said engine;

start time fuel injection performance determining means for determining whether said first fuel injection is performed when said starter switch state monitoring means determines that said starter switch is off;

elapsed time determining means for determining whether the elapsed time measured by said timer means reaches a set delay time when said start time fuel injection performance determining means determines that the first fuel injection is performed;

start command issuing and canceling control means for issuing said start command when said starter switch state monitoring means determines that said starter switch is on, continuously issuing said start command when said starter switch state monitoring means determines that the starter switch is off, said start time fuel injection performance determining means determines that the first fuel injection is performed, and said elapsed time determining means determines that the elapsed time has not yet reached the set delay time, and canceling said start command when said starter switch state monitoring means determines that the starter switch is off, and said start time fuel injection performance determining means determines that said first fuel injection is not performed, and when said starter switch state monitoring means determines that the starter switch is off, said start time fuel injection performance determining means determines that the first fuel injection is performed, and said elapsed time determining means determines that said elapsed time has reached said set delay time; and starter drive stopping means for stopping the driving of said starter motor when the start of said engine is completed and said start command is canceled, said delay time being set to time equal to or longer than time required for the cylinder into which the air/fuel mixture is taken by said first fuel injection to perform at least one exhaust stroke when said starter motor is continuously driven forward.

9. An engine starting device for starting an engine comprising at least one cylinder having a piston therein, a crankshaft connected to the piston in said cylinder, a fuel injection device that injects fuel for generating an air/fuel mixture to be supplied into said cylinder, an ignition device that ignites the air/fuel mixture compressed in said cylinder; and a starter motor that can rotationally drive said crankshaft forward and reversely, wherein said device comprises:

starter reverse rotation drive means for reversely driving said starter motor for once reversely rotating said crankshaft when a command signal for commanding to start said engine is issued;

starter forward rotation drive means for driving said starter motor forward so as to rotate said crankshaft forward after the driving of said starter motor by said starter reverse rotation drive means is finished;

fuel injection control means for causing said fuel injection device to perform first fuel injection at the start at a crank angle position within a crank angle range suitable for injecting fuel for generating the air/fuel mixture to be supplied into the cylinder of said starter forward rotation drive means rotate said crankshaft forward said engine in preparation for first ignition at the start performed by said ignition device;

start time ignition control means for causing ignition at an ignition position suitable at the start of said engine in the process of forward rotation of said crankshaft;

start time fuel injection performance determining means for determining whether said first fuel injection is performed when starter switch state monitoring means determines that a starter switch is off, start time crankshaft rotation angle determining means for determining whether the crankshaft of the engine is rotated forward by a set angle or more from the crank angle position where the first fuel injection is performed when said start time fuel injection performance determining means determines that the first fuel injection is performed;

starter switch state monitoring means for monitoring the state of the starter switch that is turned on at the start of said engine;

start command issuing and canceling control means for issuing said start command when said starter switch state monitoring means determines that the starter switch is on, continuously issuing said start command when said starter switch state monitoring means determines that the starter switch is off and said start time crankshaft rotation angle determining means determines that the crankshaft is not rotated by the set angle or more, and canceling said start command when said starter switch state monitoring means determines that the starter switch is off, and said start time fuel injection performance determining means determines that the first fuel injection is not performed, and when the starter switch state monitoring means determines that the starter switch is off, said start time fuel injection performance determining means determines that the first fuel injection is performed, and said start time crankshaft rotation angle determining means determines that the crankshaft is rotated by the set angle or more; and starter drive stopping means for stopping the driving of said starter motor when the start of said engine is completed and said start command is canceled, said set angle being set to a rotation angle or more required for the cylinder into which the air/fuel mixture is taken by said first fuel injection to perform at least one exhaust stroke when said starter motor is continuously driven forward.

10. The engine starting device according to claim 8, wherein the crank angle position where said fuel injection control means causes said first fuel injection is a predetermined position.

11. The engine starting device according to claim 9, wherein the crank angle position where said fuel injection control means causes said first fuel injection is a predetermined position.

12. The engine starting device according to claim 8, wherein the crank angle position where said fuel injection control means causes said first fuel injection is a crank angle position when a reverse driving time of said starter motor reaches a set time.

13. The engine starting device according to claim 9, wherein the crank angle position where said fuel injection control means causes said first fuel injection is a crank angle position when a reverse driving time of said starter motor reaches a set time.

14. The engine starting device according to claim 7, wherein said starter forward rotation drive means is comprised so as to continuously drive the starter motor in a direction of starting the engine until the start of the engine is confirmed even when the crankshaft stops before the piston in the cylinder of the engine reaches a top dead center of the compression stroke.

15. The engine starting device according to claim 8, wherein said starter forward rotation drive means is comprised so as to continuously drive the starter motor in a direction of starting the engine until the start of the engine is confirmed even when the crankshaft stops before the piston in the cylinder of the engine reaches a top dead center of the compression stroke.

16. The engine starting device according to claim 9, wherein said starter forward rotation drive means is comprised so as to continuously drive the starter motor in a direction of starting the engine until the start of the engine is confirmed even when the crankshaft stops before the piston in the cylinder of the engine reaches a top dead center of the compression stroke.

17. The engine starting device according to claim 10, wherein said starter forward rotation drive means is comprised so as to continuously drive the starter motor in a direction of starting the engine until the start of the engine is confirmed even when the crankshaft stops before the piston in the cylinder of the engine reaches a top dead center of the compression stroke.

18. The engine starting device according to claim 11, wherein said starter forward rotation drive means is comprised so as to continuously drive the starter motor in a direction of starting the engine until the start of the engine is confirmed even when the crankshaft stops before the piston in the cylinder of the engine reaches a top dead center of the compression stroke.

19. The engine starting device according to claim 12, wherein said starter forward rotation drive means is comprised so as to continuously drive the starter motor in a direction of starting the engine until the start of the engine is confirmed even when the crankshaft stops before the piston in the cylinder of the engine reaches a top dead center of the compression stroke.

20. The engine starting device according to claim 13, wherein said starter forward rotation drive means is comprised so as to continuously drive the starter motor in a direction of starting the engine until the start of the engine is confirmed even when the crankshaft stops before the piston in the cylinder of the engine reaches a top dead center of the compression stroke.

* * * * *

UNITED STATES PATENT AND TRADEMARK OFFICE

CERTIFICATE OF CORRECTION

PATENT NO. : 7,891,330 B2
APPLICATION NO. : 11/935004
DATED : February 22, 2011
INVENTOR(S) : Kazuyoshi Kishibata et al.

It is certified that error appears in the above-identified patent and that said Letters Patent is hereby corrected as shown below:

On the title page, section (57) ABSTRACT, line 5, after the word "of" and before the word "immediately" please insert a --:--.

In column number 14, line number 17, please delete: "300" and insert therefor --30°--.

In column 22, line 50, please delete: "a" after the word "angle" and insert therefor --α--.

In column 22, line 61, please delete: "a" and insert therefor --α--.

In column 23, line 29, please delete "," and insert therefor --;--.

In column 25, line 1, please delete ";" and insert therefor -:-.

In column 27, line 60, please delete ",:" and insert therefor --;--.

Signed and Sealed this
Tenth Day of January, 2012

David J. Kappos

David J. Kappos
*Director of the United States Patent and Trademark Office*